US007060887B2

(12) United States Patent
Pangrle

(10) Patent No.: US 7,060,887 B2
(45) Date of Patent: Jun. 13, 2006

(54) VIRTUAL INSTRUMENT

(76) Inventor: Brian Pangrle, 1312 S. Maple St., Spokane, WA (US) 99204

( * ) Notice: Subject to any disclaimer, the term of this patent is extended or adjusted under 35 U.S.C. 154(b) by 87 days.

(21) Appl. No.: 10/821,424

(22) Filed: Apr. 9, 2004

(65) Prior Publication Data

US 2004/0200338 A1 Oct. 14, 2004

Related U.S. Application Data

(60) Provisional application No. 60/462,263, filed on Apr. 12, 2003, provisional application No. 60/471,364, filed on May 16, 2003.

(51) Int. Cl.
*G10H 3/06* (2006.01)

(52) U.S. Cl. ..... 84/724

(58) Field of Classification Search ..... 84/724
See application file for complete search history.

(56) References Cited

U.S. PATENT DOCUMENTS

| | | | |
|---|---|---|---|
| 4,429,607 | A | 2/1984 | Meno |
| 4,736,662 | A | 4/1988 | Yamamoto |
| 5,081,896 | A | 1/1992 | Hiyoshi et al. |
| 5,369,270 | A | 11/1994 | Gurner et al. |
| 5,913,260 | A | 6/1999 | Buchla |
| 6,142,849 | A | 11/2000 | Horton et al. |
| 6,291,824 | B1 | 9/2001 | Battarbee et al. |
| 6,501,012 | B1 | 12/2002 | Toba et al. |
| 2002/0062726 | A1 | 5/2002 | Seiji |
| 2003/0066413 | A1 | 4/2003 | Nishitani et al. |

FOREIGN PATENT DOCUMENTS

| | | |
|---|---|---|
| DE | 3807557 | 9/1989 |

OTHER PUBLICATIONS

Wilson et al.: Proceedings of the 2003 Conference on New Instruments for Musical Expression,Montreal, Canada, May 22-24, 2003,Microcontrollers in Music HCI (6 pages).
Hasan et al.: Proceedings of the 2002 Conference on New Instruments for Musical Expression (NIME-02), Dublin, Ireland, May 24-26, 2002, The Termenova (6 pages).
Paradiso et al.: Presented at the Fourth Conference on Optical 3D Measurement Techniques, ETH, Zurich, Sep. 1997, Optical Tracking for Music and Dance (8 pages).
Dahl: Speech, Music and Hearing, Quarterly Progress and Status Report, TMH-QPSR Apr. 1997, Measurements of the motion of the hand and drumstick in a drumming sequence (6 pages).

(Continued)

*Primary Examiner*—Jeffrey W Donels
(74) *Attorney, Agent, or Firm*—Brian J. Pangrle

(57) ABSTRACT

An exemplary device includes a first emitter to emit radiation from a first perspective substantially parallel to a head of a drum or other surface, a second emitter to emit radiation from a second perspective substantially parallel to the head of the drum or other surface, detectors to detect interruptions in the radiation from the first perspective as caused by an object; and detectors to detect interruptions in the radiation from the second perspective as caused by an object, wherein detected interruptions allow for one or more determinations (e.g., sounds, sound effects and control actions). Emitters optionally emit radiation as a fan-beam and detectors are optionally arranged along an arc. Various other exemplary arrangements, devices, systems, methods, etc., are also disclosed.

20 Claims, 11 Drawing Sheets

OTHER PUBLICATIONS

Aimi: Massachusetts Institute of Technology, Sep. 2002 New Expressive Percussion Instruments (86 pages).
Mulder: Ph.D. Thesis, Simon Fraser University, Oct. 1998 (Canada), Design of Virtual Three-dimensional Instruments for Sound Control, (113 pages).
Boschi: Norges teknisk-naturvitenskapelige universitet (NTNU) i Trondheim, Norway, May 24, 2002, a Classification of Controllers for Parameters Highlighting (6 pages).
Ibrahim et al.: 1st World Congress on Industrial Process Tomography, Buxton, Greater Manchester, Apr. 14-17, 1999, p. 511, Optical Fibres For Process Tomography (6 pages).
Blaine et al.: Proceedings of the conference on designing interactive systems, NY, NY, US, 2000 pp.: 165-173, ACM SIGCHI 2000, The Jam-O-Drum Interactive (9 pages).
Haller: http://www.no-more-wutzemusik.de/midipark/midijava.pdf Sound Programming (40 pages).
Gering et al.: IEEE Workshop on Multi-View Modeling and Analysis of Visual Scenes Fort Collins, Colorado Jun. 21-23, 1999, Object Modeling using Tomography (8 pages).
Schmitz et al.: Optical Society of America, 1999, A fast versatile instrument for dynamic optical tomography (3 pages).
Schmitz et al: Review of Scientific Instruments vol. 73, No. 2 Feb. 2002, Instrumentation for fast functional optical tomography (11 pages).
Sheppard: Bachelor Engineering Paper, School of Information Technology and EE, University of Queensland, Australia, May 22, 2003, Digital Stringless Guitar (53 pages).
Emsen et al: Group Design Project, University of Southampton Faculty of Engineering and Applied Science, England, Electronic Timpani, Apr. 26, 2002 (183 pages).
Weinberg: Tweaking for Touch: Feel More Real, DRUM! 12(7), Nov./Dec. 2003 (4 pages).
Carey et al.: 1st World Congress on Industrial Process Tomography, Buxton, Greater Manchester, Apr. 14-17, 1999, p. 480, Near Infra-Red Absorption Tomography (8 pages).
Yan et al.: Meas. Sci. Technol. 13 (Dec. 2002) 1898-1902, A novel optical fibre process tomography structure for industry process control (Abstract).
Balduf et al.: Time Resolving Gamma-Tomography for Periodically Changing Gas Fraction Fields, Institute of Safety Research Annual Report 2000 (6 pages).
Kim et al.: Circle Detection Method using the Intersecting Chords, International Symposium on Robotics and Auto (ISRA 2000), Monterrey, N.L., México, Nov. 10-12, 2000 (6 pages).
Di Giuseppe: II Banjo Segato "Sawed Off Banjo"—www.thestraniero.com/stranierovision/html/banjo_i.html, Copyright 2003 (3 pages).
Schafter + Kirchhoff GMBH: CCD Line Scan Cameras: Illumination Components and Accessories, www.SuKHamburg.de (1 page).
ATMEL: ATSAM9753, Integrated Digital Music Instrument, Rev. 1774D-DRMSD-Nov. 2002 (23 pages).
ATMEL: ATSAM9753 PIA-DK Development Kit and Evaluation Board for ATSAM9753, Rev. 2660B-DRMSD-Nov. 2002 (11 pages).
Convergent Manufacturing Technologies Inc. The Enhanced Laser Velocity System, ELVS A brochure Sep. 2003 (2 pages).

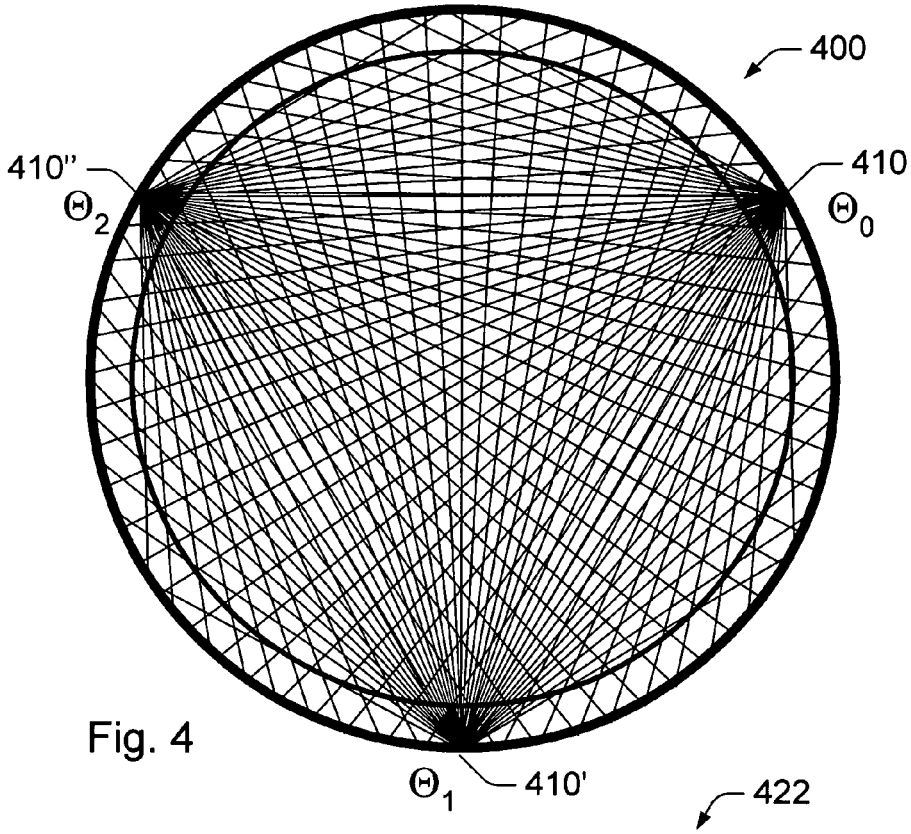
Fig. 4
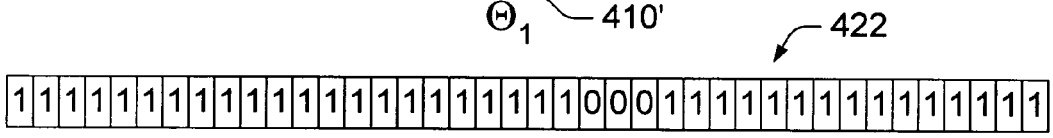
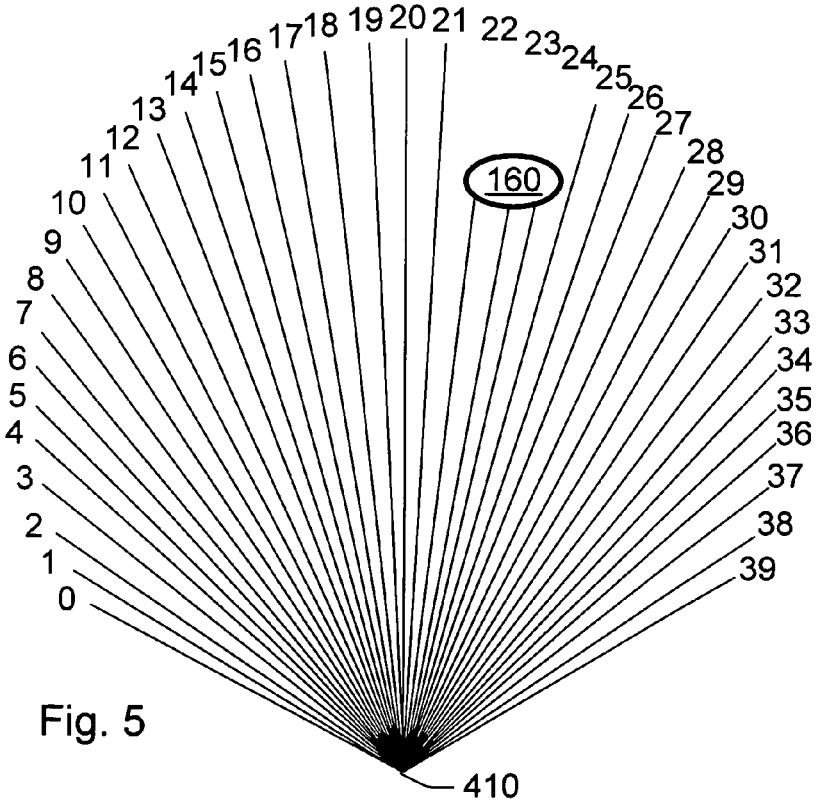
Fig. 5

| | | |

800

| | $z_0$ | $z_1$ | $z_2$ | |
|---|---|---|---|---|
| O1 Trigger Start $t_0$ | 101111 | 111111 | 111111 | |
| O2 Trigger Start $t_0'$ | 101101 | 111111 | 111111 | |
| $t_1$ | 100101 | 111101 | 111111 | |
| $t_1'$ | 100101 | 011001 | 111111 | |
| $t_2$ | 100101 | 011001 | 011111 | O1 Trigger End + Δ |
| $t_2'$ | 100101 | 011001 | 011011 | O2 Trigger End + Δ |
| $t_2 + \Delta$ | 100101 | 011001 | 001011 | |
| $t_2' + \Delta$ | 111101 | 011111 | 111011 | |

Fig. 8

900

| Pandeiro | Caixa | Pratos | Surdo | Bombo |
|---|---|---|---|---|
| Th + NDFT | x, x + δ | | | x |
| FT | x | | | |
| BH | x | | | |
| Th | x, x + δ | x | x | x |
| FT | x | | | |
| BH | x | | | |
| Th + NDFT | x, x + δ | | | x |
| FT | x | | | |
| BH | x | | | |
| Th | x, x + δ | x | x | x |
| FT | x | | | |
| BH | x | | | |

Fig. 9

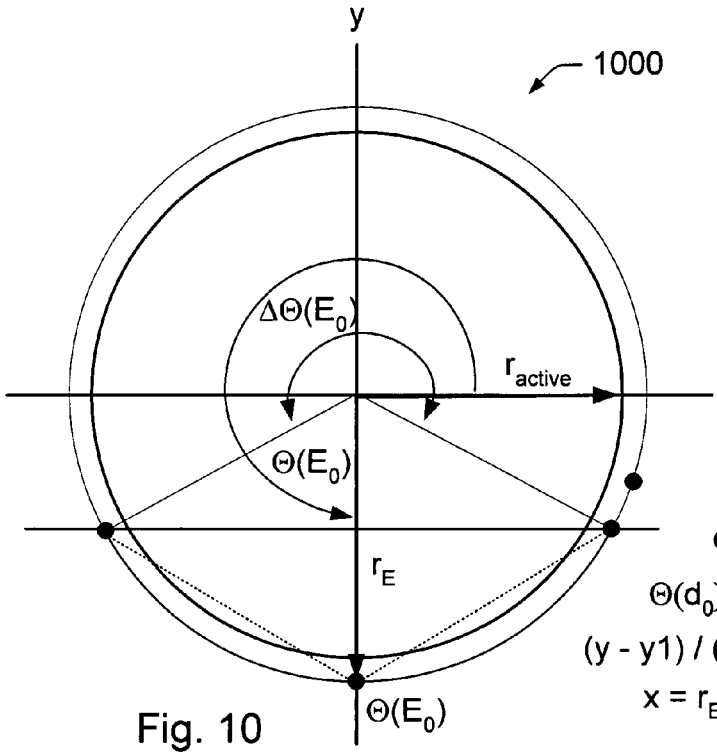

| Point 1 | Point 2 |
|---|---|
| $r_S, \Theta(E_0)$ | $r_S, \Theta(d_0)$ |
| | $r_S, \Theta(d_1)$ |
| ⋮ ⋮ | ⋮ ⋮ |
| $r_S, \Theta(E_0)$ | $r_S, \Theta(d_N)$ |

N = No. Detectors $\Delta\Theta(d_{i+1} - d_i) = \Delta\Theta(E_0)/N$ $\Theta(d_1) = \Theta(d_0) + \Delta\Theta(d_{i+1} - d_i)$ $\Theta(d_0) = \Theta(E_0) + (360 - \Delta\Theta(E_0)/2)$ $(y - y1) / (x - x1) = (y2 - y1) / (x2 - x1)$ $x = r_E\cos\Theta \qquad y = r_E\sin\Theta$

Fig. 10

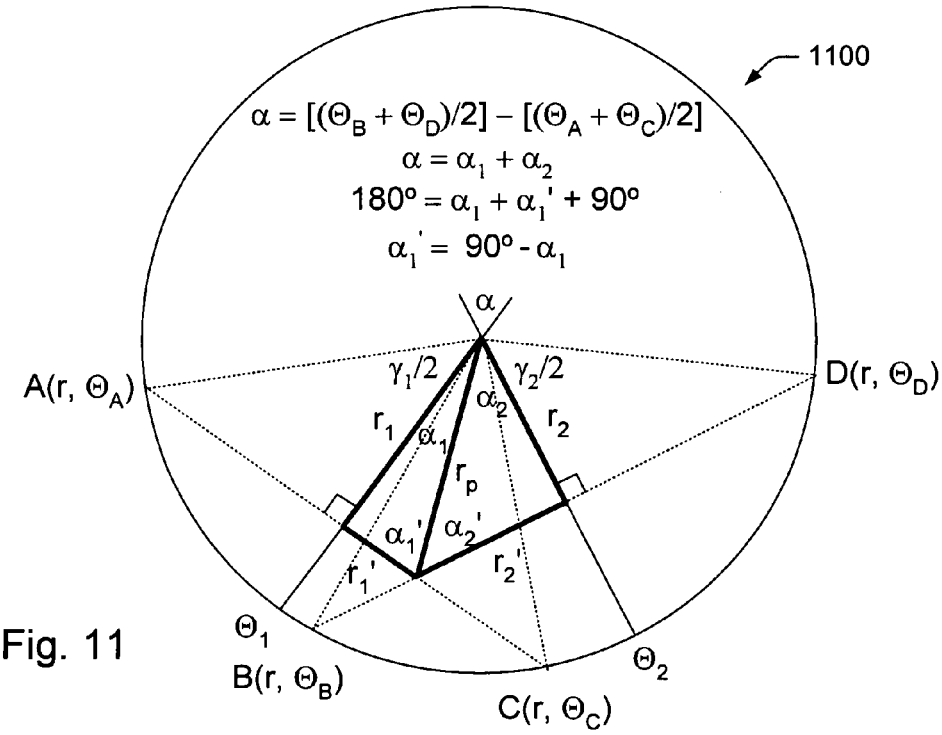

Fig. 11

$r_1 = r*\cos(\gamma_1/2) \qquad \gamma_1 = (\Theta_C - \Theta_A)$ $r_2 = r*\cos(\gamma_2/2) \qquad \gamma_2 = (\Theta_D - \Theta_B)$ $(r_1 / r_2) = \sin(90° - \alpha_1) / \sin(90° - \alpha + \alpha_1) \qquad r_p = r_1 / \sin(90° - \alpha_1)$

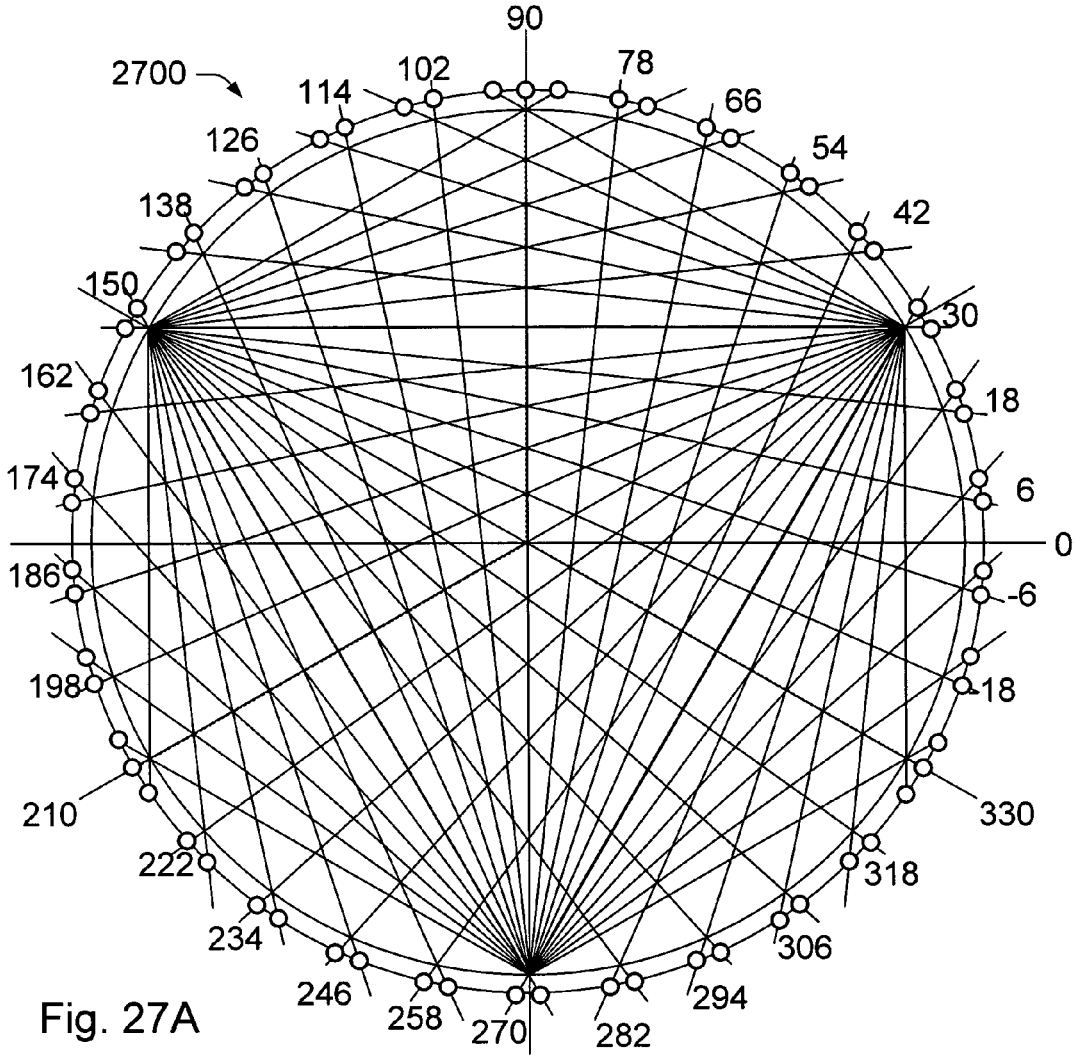
Fig. 27A
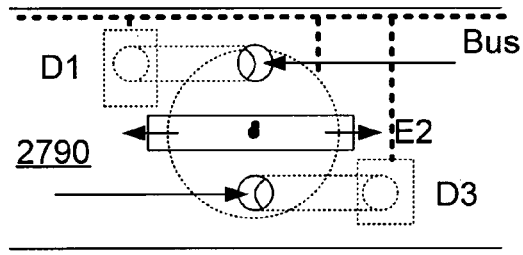
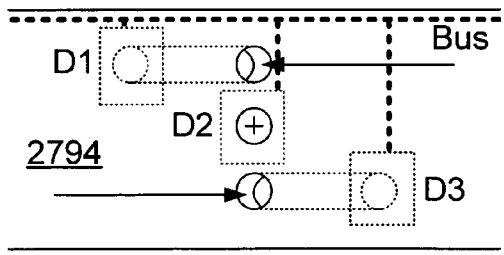
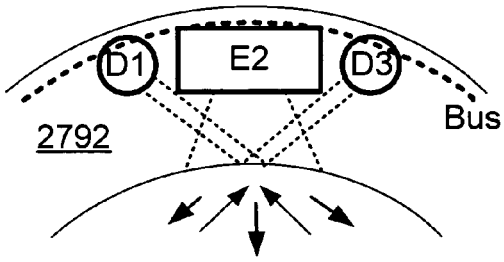
Fig. 27B
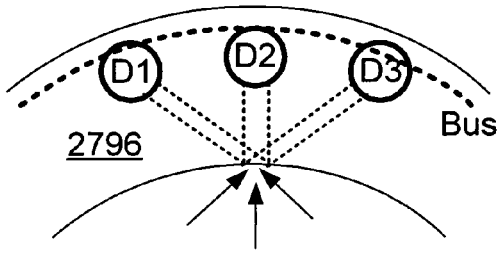
Fig. 27C

VIRTUAL INSTRUMENT

RELATED APPLICATIONS

This application claims the benefit of U.S. Provisional Application No. 60/462,263, entitled "Virtual Drum", filed Apr. 12, 2003, to Brian J. Pangrle, which is incorporated by reference herein. This application also claims the benefit of, and incorporates by reference herein, U.S. Provisional Application No. 60/471,364, entitled "Virtual Instrument", filed May 16, 2003, to Brian J. Pangrle.

TECHNICAL FIELD

Subject matter disclosed herein relates generally to electronic musical instruments and more particularly to exemplary electronic devices suitable for use with acoustic and/or electronic drums. Some exemplary devices are optionally used as stand-alone electronic musical instruments.

BACKGROUND ART

Electronic drums have emerged as alternatives to acoustic drums and various trigger mechanisms have emerged for use in conjunction with acoustic drums. While electronic drums and triggers for acoustic drums have satisfied some needs of the musician, a need still exists for alternative and/or enhanced expression. Various exemplary devices, methods, etc., disclosed herein aim to satisfy this and/or other needs.

DISCLOSURE OF THE INVENTION

The description and drawings presented disclose various exemplary arrangements, devices, systems, methods, etc., many aimed in part at alternative and/or enhanced musical expression. A brief description of the drawings follows, which is followed by a description that includes best mode and modes for carrying out the invention or inventions. Demonstration examples of various exemplary arrangements, devices, systems, methods, etc. are also presented. Various exemplary methods are optionally embodied in part as information in a computer-readable medium suitable for execution in conjunction with, for example, a microprocessor.

BRIEF DESCRIPTION OF DRAWINGS

FIG. 4 is a diagram of an exemplary device that includes three emitters oriented to emit radiation to illuminate one or more points along an arc.

FIG. 5 is a diagram of an exemplary arrangement of an emitter and detectors.

FIG. 6B is a cross-sectional diagram of the exemplary device of FIG. 6A; and FIG. 6C is a diagram of various values corresponding to an object.

FIG. 7 is a diagram of an exemplary timing sequence for detection of an object.

FIG. 8 is a diagram of an exemplary timing sequence for detection of two objects.

FIG. 9 is a diagram of an exemplary timing sequence associated with instrumental sounds.

FIG. 10 is a diagram of an exemplary method of arranging detectors with respect to a circumference of a circle.

FIG. 11 is a diagram of an exemplary method of determining a position based on chord information.

FIGS. 27A–27C are diagrams of an exemplary arrangement that includes three emitters and sixty-two detectors.

BEST MODE AND MODES FOR CARRYING OUT THE INVENTION(S)

Various exemplary arrangements, devices, systems, methods, etc., disclosed herein include and/or use one or more emitters and/or one or more detectors. An emitter is optionally passive and associated with a source optionally located remote from the emitter and supplying radiation to the emitter (e.g., via reflection, transmission, etc.). An emitter may be a source, for example, a light emitting diode may be considered both a source and an emitter. Similarly, a detector is optionally passive wherein a sensor may be located remote from the detector and receive radiation from the detector (e.g., via reflection, transmission, etc.). Optical components such as an optical fiber cable, waveguide, mirror, prism, etc., may allow for detector to sensor operation. A detector may be a sensor, for example, a photodiode may be considered both a detector and a sensor. Relays, amplifiers and/or other components are optionally used to allow for detector to sensor operation, source to emitter and/or other operations.

Various exemplary arrangements, devices, systems, methods, etc., include, generate and/or use one or more radiation paths wherein a radiation path may be defined as a ray between an emitter and a detector (e.g., sometimes referred to as "emitter/detector path"). A path or a ray may be optionally defined with respect to one or more boundaries, dimensions, etc. For example, an exemplary device may include 2-D coordinates of a polar coordinate system wherein a ray may be defined with respect to a radial value (e.g., r) and two angular values (e.g., $\Theta_1$, $\Theta_2$), two radial values (e.g., $r_1$, $r_2$) and two angular values (e.g., $\Theta_1$, $\Theta_2$), etc. Higher dimension coordinates, higher dimension coordinate systems and/or multiple coordinate systems may be used.

Figure 1A:
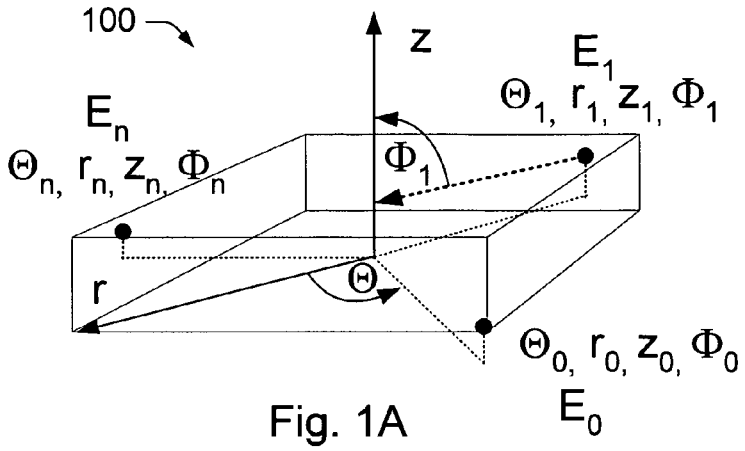
FIG. 1A is a plot of a three-dimensional space.
Figure 1B:
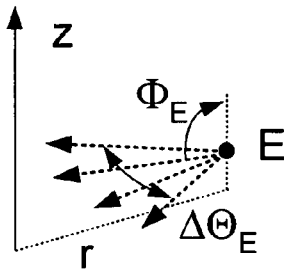
FIG. 1B is a plot of an emitter and radiation.
Figure 1C:
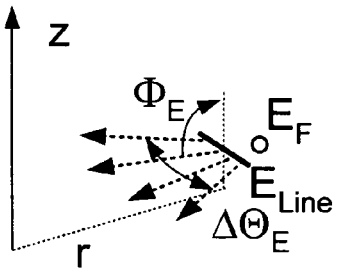
FIG. 1C is a plot of an emitter that includes a focus.

FIG. 1A shows an exemplary volume and emitters ($E_0$, $E_1$, $E_2$) with respect to a cylindrical coordinate system 100. While the exemplary volume appears as a box, other shapes are possible (e.g., cylinder, polytope, etc.). The emitters are positioned at respective Θ, r and z positions. For example, Θ corresponds to angles of 0° to 360°, r corresponds to distance from and outwardly normal to the z-axis (e.g., Φ~0°), and z corresponds to a distance along the z-axis, optionally defined with respect to a surface (e.g., a lower or upper surface of an exemplary device, an underlying surface, etc.). Altitude Φ allows for description herein of radiation emitted from an emitter at any angle from −90° to +90° with respect to the z-axis (e.g., emitted radiation that is substantially parallel to an r,Θ plane has Φ~0° or, for example, +/− several degrees). Emitted radiation may have a discrete or continuous range of Φ (e.g., ΔΦ). Another Φ and Θ correspond to an emitter and are designated $\Phi_E$ and $\Theta_E$, respectively. FIG. 1B shows an exemplary emitter, E, and angles $\Phi_E$ and a range $\Delta\Theta_E$. An exemplary emitter may include a discrete or continuous range of $\Phi_E$ (e.g., $\Delta\Phi_E$) and/or Θ (e.g., $\Delta\Theta_E$). An emitter that emits a "spot" radiation beam (e.g., a conventional laser pointer commonly used for presentations) typically has a small $\Delta\Phi_E$ (e.g., +/− several degrees) and a small $\Delta\Phi_E$ (e.g., +/− several degrees). FIG. 1C shows an exemplary emitter, $E_{Line}$, that includes a focus, $E_F$. In this example, the $\Delta\Theta_E$ is defined with respect to the focus, $E_F$. A $\Delta\Phi_E$ may also be defined with respect to the focus $E_F$.

An exemplary device optionally includes a first emitter to emit radiation from a first perspective substantially parallel to a surface, a second emitter to emit radiation from a second perspective substantially parallel to the surface, detectors to detect interruptions in the radiation from the first perspective as caused by an object; and detectors to detect interruptions in the radiation from the second perspective as caused by an object, wherein detected interruptions allow for one or more determinations (e.g., sounds, sound effects and control actions). An exemplary method optionally includes emitting radiation from a first perspective substantially parallel to a surface, emitting radiation from a second perspective substantially parallel to the surface, acquiring information from detectors wherein the information indicates whether an object interrupted the radiation from the first perspective and/or indicates whether an object interrupted the radiation from the second perspective and, based at least in part on the information, determining one or more sounds, sound effects and/or control actions.

In general, projection techniques rely on illuminating a volume from more than one perspective (e.g., optionally defined with respect to a coordinate system for the volume), detecting transmitted illumination (or lack thereof), and determining a position and/or other information for any object that enters, exits, moves and/or lies at least partially within the volume.

Tomography typically relies on aspects of such projection techniques. The word "tomography" is derived from the Greek words "tomos" meaning "to slice" and "graph" meaning "image". Various exemplary methods optionally include aspects of tomography. For example, techniques used to reconstruct images based on projection data are optionally used in various exemplary methods. Such techniques include, but are not limited to, Fourier transform techniques (and inverse thereof), Radon transform techniques (and inverse thereof), back projection techniques, filtered back projection techniques, and systems of equations techniques. Yet other techniques may be used.

Figure 2:
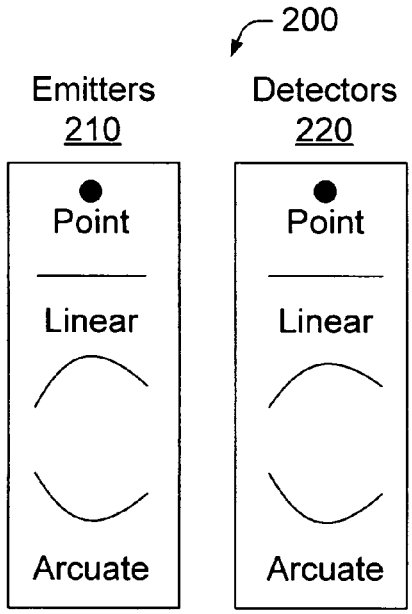
FIG. 2 is a diagram illustrating various emitters and detectors.

FIG. 2 shows various exemplary emitters and exemplary detectors which are suitable for use in various exemplary devices, methods, systems, etc., described herein. Exemplary emitters include, but are not limited to, point, linear and arcuate emitters, which may be emitter arrays (1-D, 2-D, etc.). An emitter may be a laser, a fiber optic, a light emitting diode, a mirror, a lens, an opening, a pressure generator, a nuclear radiation source, etc. An emitter may emit illuminating radiation in most any direction. A light emitting diode may be a laser diode and the wavelength(s) of the light correspond to visible and/or invisible (e.g., to the human eye) parts of the electromagnetic spectrum. In general, an emitter emits radiation, which may be electromagnetic and/or other radiation.

An emitter is optionally combined with a lens, a waveguide, a collimator, a mirror, a prism, etc., to emit radiation in a desired direction or directions. For example, a cylindrical lens or a slit may help to direct radiation as a substantially planar fan. A fiber bundle may be used to produce a plurality of emitters from a single source. In this example, fiber ends may be arranged to form a fan or other pattern. A collimator is generally a device that renders divergent or convergent rays more nearly parallel. A waveguide is generally a material medium that confines and guides a propagating electromagnetic wave (e.g., optical fiber).

A linear emitter typically emits radiation perpendicular to a linear surface; however, a linear emitter may optionally emit radiation at any of a variety of angles (e.g., consider a 90° mirror with a 45° surface). A linear emitter may have one or more focal points or foci. Arcuate emitters may emit radiation outwardly as a cone, a fan, etc. Arcuate emitters are optionally defined with respect to a focal point or focus and/or other geometry such as that used in description of lenses, optical elements, radar, collimators, waveguides, etc. Some emitters may include curvilinear shapes and/or foci.

Exemplary detectors include, but are not limited to, point, linear and arcuate detectors, which may be detector arrays (e.g., 1-D, 2-D, etc.). Some detectors may include curvilinear shapes and/or foci. The discussion on focal points or foci of emitters may apply to detectors as well. Emitters and detectors may be selected based on any of a variety of factors, some of which are discussed below.

Various line generating emitters exist. Often, these include optical elements (e.g., lens, etc.) that allow for line generation from a radiation source. Various examples are listed as full fan angle and line length in millimeters at a distance of approximately 30 cm: (0.7°, 3.7); (2.8°, 12.7); (4.0°, 20.3); (5.5°, 30.5); (7.6°, 38.0); (15°, 78.7); (18°, 96.5); (23°, 124); (36°, 198.0), (60°, 350.5); and (90°, 610.0). LASIRIS™ Mini Laser, marketed by StockerYale (Salem, N.H.) include the following modules, some of which produce other radiation beam patterns: 503L or 703L (3 lines 1.5°, 5.0°, 11.7°); 501S (1 square 2.9°); 504G (4×4 grid 2.44°); 501H (crosshair); 501C 1 (circle 11.40); 507X (7×7 dot matrix 1.9°); and optics for fan beams with fan angles of approximately 1°, 5°, 10°, 15°, 20°, 30°, 45°, 60°, 75°, 90°, and 120°. With respect to wavelengths and power StockerYale markets 635 nm (1, 3, 5, 10, 35 mW), 650 nm (1, 3, 5, 10 mW), 660 nm (20, 35 mW), 670 nm (1, 5, 10 mW), 685 nm (20, 35 mW), 690 nm (35 mW), 785 nm (5, 30, 35 mW), and 830 nm (40 mW). Other optical components include 90°, elbows and prisms for 90° reflection at various orientations with respect to an emitter body. Refractive and/or defractive optics may be used. LED arrays, fiber optic line light guides, etc., are available commercially from Edmund Industrial Optics, Barrington, N.J. and are optionally used. Various components are available from companies such as Melles Griot, Rochester, N.Y. Emitters that emit green, blue, red and other color visible radiation are commercially available. Emitters are available in a variety of sizes. For example, Lasermate, Inc. (Pomona, Calif.) markets laser diodes with substantially cylindrical package sizes of about 4 mm in length (not including leads) and less than about 6 mm in diameter.

Emitters may emit continuous wave, pulsed, etc., radiation. For example, interrupted continuous wave radiation involves modulation in which there is on-off keying of a continuous wave. Emitter modulation may be coordinated. For example, an emitter may be modulated in coordination with of one or more other emitters. Such coordination can create efficiencies such as allowing a detector to provide information from more than one emitter/detector path. In other instances, a detector may allow for discrimination of radiation of different wavelengths, which may allow for a detector to provide information from more than one emitter/detector path. Various emitters are controllable via TTL (transistor-transitor logic) signals. For example, Lasermate, Inc. (Pomona, Calif.) markets a LTG6504A5-T laser that can operate to about 100 kHz via three wires: power, ground, TTL control. As described herein, a pulsed emitter may include pulsing (e.g., one or more pulses) that occurs in response to an object-related event (e.g., emitter/detector radiation path interruption, on-command, timing sequence, etc.) and/or a programmed schedule.

In general, emitters emit radiation in a pattern that does not vary with respect to time (e.g., other than on/off); however, an emitter may include a shutter, a moving component, or other mechanism that allows for emission of a pattern that varies with respect to time and/or changes orientation with respect to time. For example, a shutter (e.g., mechanical, electronic, etc.) may allow for a rotating beam that sweeps across detectors with respect to time. Other examples are available from the art of computerized axial tomography where X-ray emitters and/or detectors may rotate, translate, etc., with respect to time.

Figure 3:
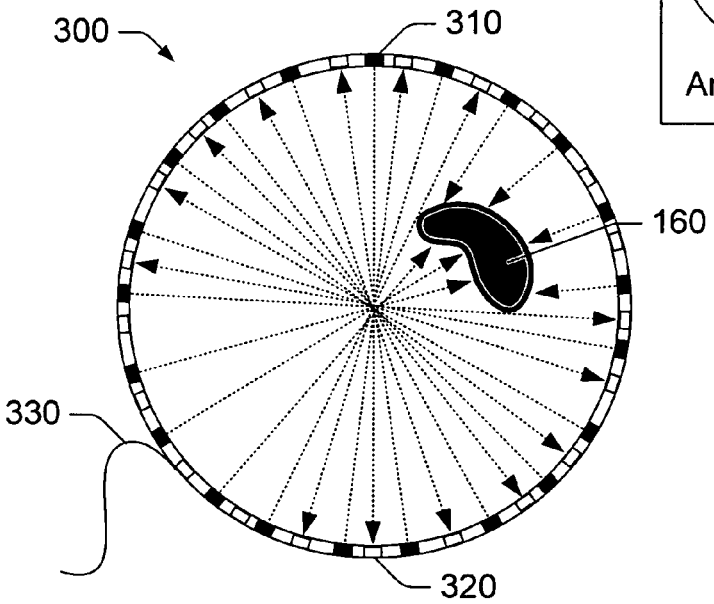
FIG. 3 is a diagram of an exemplary device capable of detecting an object.

FIG. 3 shows an exemplary arrangement of emitters and detectors 300. The arrangement 300 includes emitters 310 and detectors 320 positioned at a radius about a central axis (e.g., a z-axis). As shown, this exemplary arrangement includes a cable to transmit and/or receive information and/or energy to and/or from the emitters 310 and/or detectors 320. FIG. 3 also shows an object 160 interrupting radiation paths between various emitters and detectors. In this example, radiation emitted by the emitters may be of insufficient intensity and/or wavelength to be transmitted through the object 160. An approximate position of the object 160 may be determined based on whether a detector receives radiation from an associated emitter. In yet other examples, a detector may provide a value corresponding to how much radiation it receives (e.g., as in conventional X-ray CT).

Of course, orthogonal and/or rectilinear arrangements of emitters and/or detectors are also possible, especially, but not limited to, those that may act to minimize risk of aliasing two objects or more even objects. Other arrangements of detector and emitter components may include polygonal, triangular, and other geometries. For example, a triangular arrangement may optionally have emitters located at triangle vertices and optionally detectors along opposing legs.

Various exemplary arrangements, devices, systems, methods, etc., include detectors for detecting information and logic for associating the information with a real and/or a virtual membrane capable of vibrating to produce sound and/or producing a sound representative of a vibrating membrane. For example, many drums include a drum head that is a substantially circular membrane. Circular membranes are known to have various modes of vibration, which may be defined by a mode number that includes nodal diameters and circular nodes (e.g., (0,1), (1,1), (1,2), (2,1), (3,1), (4,1), and (5,1), etc.). Various exemplary arrangements, devices, systems, methods, etc., can operate in conjunction with an acoustic drum and/or a conventional electronic drum and/or independent of an acoustic drum and/or a conventional electronic drum. Various exemplary arrangements, devices, systems, methods, etc., can operate to collect information for use in reproducing sounds, sequences of sounds and/or sound effects. For example, an exemplary arrangement may be used to generate information to construct messages (e.g., messages according to the Musical Instrument Digital Interface (MIDI) protocol) that can be used immediately and/or belatedly to produce sound, sequences of sound (e.g., music, etc.), and/or sound effects.

FIG. 4 shows an exemplary arrangement 400. The exemplary arrangement 400 allows for sampling or acquiring information from detectors to determine if an object lies at least partially within a sampling area or sampling volume defined, at least in part, by illuminating radiation associated with emitters and detectors. The exemplary arrangement 400 includes three fan-beam emitters 410, 410', 410" (e.g., spaced at approximately 120° intervals and each emitter fanning out over an arc of approximately 240°, for example, with some azimuthal, but not necessarily axial, overlap). In this example, the fan-beam emitters 410, 410', 410" include a $\Delta\Theta_E$ of about 120°. While a certain number of rays or emitter/detector paths are shown for each emitter 410, 410', 410", in this example, the number of effective rays typically depends on the number of detectors. In general, a ray represents a radiation path between an emitter and a detector. Any particular detector and/or emitter may optionally be used to form one or more paths.

In the exemplary arrangement 400, emitters are positioned approximately along the circumference of an outer circle (or may have foci corresponding thereto) and an inner circle approximately defines a detection area in this 2-D view that may be associated with a volume. While the emitters 410, 410', 410" are shown at certain angles (e.g., $\Theta_0$, $\Theta_1$, $\Theta_2$), other angles may be used. In general, a path between an emitter and a detector forms a chord with respect to the outer circle and/or the inner circle. Further, various chords intersect, typically wherein each of the intersecting chords is associated with a different emitter. In general, chord information may be used to help determine a position for an object that interrupts one or more radiation paths (e.g., for a single path, the object is at a position along that path).

FIG. 5 shows an object 160 in an exemplary emitter fan-beam 410 and a change in an associated binary vector 422. In this example, the object 160 prevents radiation from reaching detectors labeled 22, 23 and 24. Of course, if the object is at least semi-transparent to the illuminating radiation provided by the emitter, then the detectors labeled 22, 23 and 24 may experience a lesser level of transmitted radiation when compared to the other detectors. In other examples, detector information may be analog and/or digital with a bit depth greater than 1 bit.

Figure 6A:
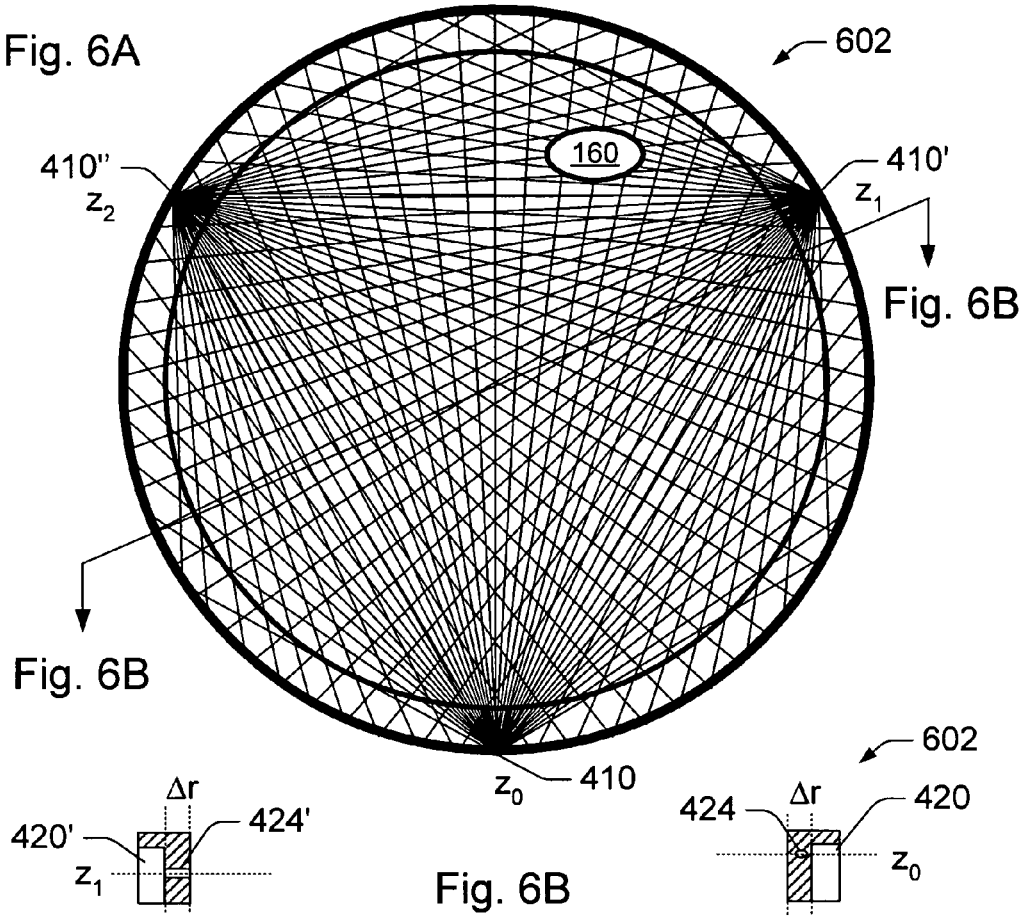
FIG. 6A is a diagram of an exemplary device that includes three emitters wherein each emitter projects radiation in a plane and each plane is positioned at a different axial position.

FIGS. 6A, 6B and 6C show an exemplary scenario including a top view of an exemplary device 602, a cross-sectional view of the exemplary device 604 and a binary array 422, 422', 422" associated with the device 602. In this particular example, the emitters 410, 410', 410" are optionally positioned at different positions along a z-axis in a cylindrical coordinate system. As shown in FIG. 6B, the device 602 has a substantially rectangular cross-section. Of course, other cross-sections are possible (e.g., circular, oval, triangular, etc.). Each cross-section shows a detector 420, 420' and an associated collimator 424, 424'. The collimator 424 has a position along the z-axis of approximately $z_o$, which is associated with the emitter 410. In this example, the barrel of the collimator 424 does not entirely coincide with a radial line of the outer circle or the inner circle; hence, in the cross-sectional view, the collimator 424 appears as an oval. Along a radial line, the collimator 424 has a radial distance of approximately Δr. In this example, the collimator 424 acts to collimate radiation emitted from the emitter 410. In this example, the collimator 424 helps to direct transmitted radiation to the detector 420 at an axial height of approximately $z_0$. In general, use of a collimator helps to link a detector with a particular emitter. Of course, a collimator may also act to link a detector with more than one emitter. A collimator may be a baffle and operate to diminish stray radiation (e.g., ambient and/or other radiation). A collimator may have a non-reflecting and/or reflecting surface (e.g., inner wall surface), which may depend on position of a sensor and/or a detector with respect to a radiation path defined by a collimator opening that may serve to define a detector/emitter radiation path.

The collimator 424' has a barrel that coincides substantially with a radial line; therefore, the collimator 424' appears as a rectangular section at an approximate height of $z_1$. According to this example, a set of collimators exist at $z_0$ that correspond to paths between the emitter 410 and associated detectors (e.g., having outputs represented by the vector 422 for detectors capable of detecting transmitted radiation at $z_0$). Again, the paths generally form chords of the inner circle and/or the outer circle. Further, a set of collimators exist at $z_1$ that correspond to paths between the emitter 410' and associated detectors (e.g., having outputs represented by the vector 422' for detectors capable of detecting transmitted radiation at $z_1$). Yet further, a set of collimators exist at $z_2$ that correspond to paths between the emitter 410" and associated detectors (e.g., having outputs represented by the vector 422" for detectors capable of detecting transmitted radiation at $z_2$). In the example of FIG. 6A and 6C, an object 160 has interrupted various paths, which are indicated by the vectors 422, 422', 422".

Various exemplary devices include filters, shades, baffles, etc., to improve signal to noise ratio and/or other operation. For example, a detector may include a filter that allows for passage of certain wavelength radiation while substantially filtering out certain other wavelengths of radiation. While the exemplary device of FIGS. 6A and 6B includes features such as the collimators 424, 424', in various other examples, an exemplary device does not include such features. Modulation, timing, matching of emitters and detectors, etc., can operate to minimize effects of ambient radiation, stray radiation, etc. An exemplary device optionally includes one or more sensors for sensing ambient radiation and making adjustment in response to characteristics of ambient radiation (e.g., intensity, wavelength, direction, etc.).

An exemplary device optionally includes one or more grooves or slots. For example, an arc shaped groove may have an axial height and a radial depth wherein radiation enters the groove via a first radial position and reaches a detector at a second radial position wherein the radial depth may correspond substantially to the distance between the first position and the second position. In such an example, the height and the depth of the groove may be selected to help exclude ambient radiation, stray radiation, etc. (e.g., by creating a limited angle-of-view for one or more detectors). In instances where an emitter emits radiation at an angle Φ (e.g., typically including a corresponding $\Phi_E$) that differs from 0° then a groove may also have an angle $\Phi_G$ that differs from 0°. As such a groove may have an arc angle $\Theta_G$ (or $\Delta\Theta_G$) and another angle $\Phi_G$ (or $\Delta\Phi_G$).

An exemplary scenario includes corresponding exemplary equations for velocity (e.g., a time difference for a distance or relative times for events) and acceleration for planar levels and exemplary dependencies for helical or spiral configurations of detectors. For example, the exemplary vectors 422, 422', 422" correspond to 120 detectors. A first set of detectors assigned to the vector 422 have exemplary binary values assigned from 0 to 39 that are associated with radiation from an emitter $E_0$ (e.g., $z_0$). A second set of detectors assigned to the vector 422' have exemplary binary values assigned from 40 to 79 that are associated with radiation from an emitter $E_1$ (e.g., $z_1$). A third set of detectors assigned to the vector 422 have exemplary binary values assigned from 80 to 119 that are associated with radiation from an emitter $E_2$ (e.g., $z_2$). In this example, an object that interrupts a path causes the detector corresponding to the path to register a binary value of 0 while a substantially uninterrupted path causes the detector corresponding to the path to register a binary value of 1. Of course, other values may be used (e.g., greater bit depth, tri-state, etc.) or the values may be reversed (e.g., interrupted=1; uninterrupted=0). Such information may be considered state information, for example, state information that specifies an interrupted state and an uninterrupted state.

In this example, the detectors associated with the vectors may be arranged in any suitable manner, such as, but not limited to, planar, spiral, helical, double helical, etc. In any of these arrangements, timing may be introduced within a set of detectors and/or between two or more sets of detectors. If the three sets of detectors correspond to three planar levels (e.g., $z_0$, $z_1$, $z_2$), then time intervals may be determined between detectors at a first level, detectors at a second level and detectors at a third level. With respect to detection of an object's motion, planar and/or angular motion (including vertical along the z-axis) may be detected using detectors in one or more of the first, second or third set of detectors. Given an example with three levels and an object moving downward from the first to the second to the third level, the detectors may detect a first velocity (or time difference) and a second velocity (or time difference). Hence, acceleration may be determined based on a difference between the first velocity and the second velocity. Of course, additional layers may allow for higher order determinations of motion and/or more accurate determinations of motion. For detectors arranged in a helical or spiral manner, such determinations may also be made. Various exemplary devices, systems, methods, etc., optionally rely on detectors distributed over a thickness Δz in the axial direction for an exemplary device described in cylindrical coordinates and capable of determining at least a planar position of an object wherein the object at least partially lies within a volume defined by emitter to detector paths. Exemplary equations include wherein "V" is velocity and "a" is acceleration:

Planar:

$$E_0=z_0,t_0;\ E_1=z_1,t_1;\ E_2=z_2,t_2$$

$$V_0=(z_0-z_1)/(t_1t_0);\ V_1=(z_1-z_2)/(t_2-t_1);\ a_0=(V_1-V_0)/(t_2-t_0)$$

Helical, Spiral, Other:

$$E_0(\Theta)=z_0(\Theta),t_0(\Theta);\ E_1(\Theta)=z_1(\Theta),t_1(\Theta);\ E_2(\Theta)=z_2(\Theta),t_2(\Theta)$$

FIG. 7 shows an exemplary scenario 700 for triggering a start of an event and triggering an end of the event together with various exemplary parameters. In this example, a first vector at time to indicates that a path corresponding to a detector at $z_0$ has been at least to some degree interrupted (e.g., a decrease in transmitted radiation). In general, this indicates that an object has entered the volume defined by emitter and detector transmission paths. This event may trigger an algorithm that determines and/or uses one or more parameters. A second vector at time ti indicates that a path corresponding to a detector at $z_1$ has been at least to some degree interrupted (e.g., a decrease in transmitted radiation). Accordingly, this event may trigger an algorithm. A third vector at time $t_2$ indicates that a path corresponding to a detector at $z_2$ has been interrupted (e.g., a decrease in transmitted radiation). This event may trigger an algorithm that terminates a sampling window (or data acquisition window), for example, after an optional time delay Δ. Note that sampling (or data acquisition) optionally occurs more frequently than times $t_0$, $t_1$, $t_2$, etc.

Information of the vectors may be used to determine various parameters. For example, vector information for interruption of a path corresponding to a detector at $z_0$ and interruption of a path corresponding to a detector at $z_1$ may be used to determine a position and/or other parameter.

With respect to position and/or area determinations, a variety of algorithms may be used (e.g., Boolean logic, reconstruction, look-up table, etc.). Exemplary algorithms include, but are not limited to, those associated with tomography and those that are discussed further below. With respect to velocity determinations, finite difference and/or other discretization techniques may be used to determine velocity and/or acceleration. Further, such determinations may include averaging and/or other techniques. Yet further, a variety of algorithms may be used (e.g., Boolean logic, reconstruction, look-up table, etc.). With respect to momentum (e.g., product of mass and velocity) determinations, a variety of algorithms may be used (e.g., Boolean logic, reconstruction, look-up table, etc.). In general, mass may be an unknown and optionally programmable and/or determinable based on a model that accounts for any of a variety of factors that may relate to an object, a family of objects, etc. For example, potential objects may be confined to a family of objects. In this example, known masses are optionally assigned to the objects along with, for example, information about the objects. Consider a mallet as an object, which has a definable geometry and a definable manner of entering a volume defined by radiation transmission paths between one or more emitters and one or more detectors. Various areas are optionally assigned to the mallet object wherein upon detection of an area associated with (e.g., that correlated to) the mallet object, a mass is assigned to the object. Depending on particulars of an exemplary device, volume may be used. In instances where an exemplary device is used in conjunction with a piezoelectric type of device (e.g., a conventional electronic drum) that registers impact of an object, such information may be used in conjunction with information collected by the exemplary device. In instances where an exemplary device includes or is used in conjunction with reflected radiation information pertaining to movement of an object, then such information may be used in conjunction with information collected via interruption of one or more radiation paths.

An exemplary method includes introducing an object at least partially into a volume in one or more manners to thereby calibrate the object. For example, the calibration may determine cross-sectional area, volume, etc. of an object. The exemplary method optionally allows a user to associate or identify an object with a calibration and/or optionally automatically select an object for a calibration. Consider placing a hand at least partially into the volume in one or manners to thereby calibrate the hand. For example, a first manner includes placing the hand into the volume substantially parallel to the volume with fingers spread. A second manner includes placing the hand into the volume substantially parallel to the volume with fingers together. A third manner includes placing the hand into the volume at an angle. Of course, such an exemplary method could be performed on both hands and/or various other objects. For example, where an exemplary device serves as a virtual drum, a player may register or calibrate one or more drumming implements if provided with a suitable exemplary method such as the aforementioned exemplary method.

With respect to force (e.g., product of mass and acceleration) determinations, a variety of algorithms may be used including a look-up table. As with momentum, force relies on mass. Thus, the aforementioned discussion on mass with respect to momentum also applies to force. With respect to pressure (e.g., force per unit area) determinations, a variety of algorithms may be used including a look-up table. As with momentum, force relies on mass. Thus, the aforementioned discussion on mass with respect to momentum also applies to force.

An exemplary two object scenario includes an associated binary array and applies to the exemplary scenario of FIG. 6A and FIG. 6C wherein another object interrupts paths. Such an exemplary two object scenario demonstrates an ability to detect two objects in a volume defined by paths between one or more emitters and one or more detectors. In particular, depending on object size and emitter/detector configuration, risk of aliasing may be reduced. Aliasing may occur, for example, when two objects are positioned in a rectangular and orthogonal grid (e.g., two sets of parallel lines oriented orthogonally) and four possible positions result for the two objects (two correct positions and two alias positions).

An exemplary two object scenario corresponding to FIGS. 6A and 6C may apply to determining the position of two objects even if the objects have circular cross-sections, each cross-section having a diameter equal to approximately the radius of the inner circle. A discussion on aliasing appears in an article entitled "Optical Fibres For Process Tomography: A Design Study" by Ibrahim et al., 1st World Congress on Industrial Process Tomography, Buxton, Greater Manchester, Apr. 14–17, 1999, p. 511, which is incorporated by reference herein.

Figure 19:
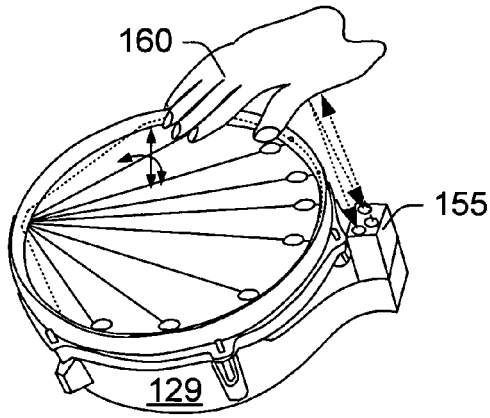

While various exemplary arrangements, devices, systems, methods, etc., rely on transmission, other various exemplary arrangements, devices, systems, methods, etc., may rely, at least in part, on reflection of radiation from an object; noting that a distinction exists between an emitter that emits radiation from a source via reflection (e.g., a mirror, a prism, etc.) and a detector that transmits radiation to a sensor via reflection (e.g., a mirror, a prism, etc.) and radiation received by a detector wherein the radiation was reflected by an object (see, e.g., the example of FIG. 19 below).

FIG. 8 shows an exemplary scenario 800 for registering events for an exemplary two object scenario. The exemplary scenario of FIG. 8 includes a variety of times and corresponding exemplary vectors having bit values of 0 or 1. At time $t_0$, a first object is detected in a detector associated with an axial position of $z_0$. At time $t_0'$, a second object is detected in a detector associated with an axial position of $z_0$. At time $t_1$, the first object is detected in a detector associated with an axial position of $z_1$. At time $t_1'$, the second object is detected in a detector associated with an axial position of $z_1$. At time $t_2$, the first object is detected in a detector associated with an axial position of $z_2$. At time $t_2'$, the first object is detected in a detector associated with an axial position of $z_2$. At time $t_2+\Delta$, the first object and the second object are detected in detectors associated with axial positions of $z_0$, $z_1$ and $z_2$. At time $t_2'+\Delta$, the second object is detected in detectors associated with axial positions of $z_0$, $z_1$ and $z_2$. In some instances, one object may remain in the volume defined by transmission paths between one or more emitters and one or more detectors. As demonstrated, an exemplary device may still detect and determine the position of a second object when one object already lies within the volume defined by transmission paths between one or more emitters and one or more detectors. For example, where an exemplary device serves as a virtual drum, a player may use one mallet to dampen a virtual drum head and use another mallet to strike the virtual drum head. Various exemplary arrangements, devices, systems, methods, etc., described herein can relatively simultaneously determine a position for a substantially stationary object and a striking object in a volume defined by transmission paths between one or more emitters and one or more detectors. Further, some drummers use an elbow or other objects to affect drum head response. Yet further, some drummers drag an object over a drum head. Various exemplary devices, systems, methods, etc., can serve as a virtual drum that is responsive to such actions and/or can serve as an adjunct to a drum that may be responsive to such actions.

In general, for two objects and three levels (wherein i is a path at level 1, j is a path at level 2 and k is a path at level 3), the following possibilities may exist wherein the first object interrupts one or more paths at each level:

Object 1—Ex: L1i-L2j-L3k

Object 2—Ex.1: L1i'-L2j'-L3k (L3k blocked by Object 1); Ex.2: L1i'-L2j -L3k '(L2j blocked by Object 1); and Ex.3: L1i -L2j '-L3k '(L1i blocked by Object 1).

Note that in the Ex.1, Ex.2, and Ex.3, it is still possible to determine a velocity for Object 2. Of course, some other possibilities exist as well; however, where Object 1 and Object 2 interrupt one or more same paths at more than one level, then it is likely some overlap of position of Object 1 and Object 2 exists.

Various exemplary devices are suitable for mounting on a conventional drum (e.g., acoustic and/or electronic) and/or are suitable for use as a retaining and/or tensioning device for a drum head. In general, such an exemplary device when used as a tensioning device will tension a drum head with minimal deformation to ensure alignment of various emitters and/or detectors. Further, such an exemplary device, whether mounted or functioning as part of a conventional drum, is optionally switched on or off to selectively allow for electronic enhancement. Yet further, various exemplary devices may serve to detect drum head motion where a drum head interrupts one or more emitter/detector paths. In this example, a path may be positioned at a distance above or below a drum head such that motion and/or distortion of the drum head upon being contacted with an implement (e.g., stick, hand, etc.) causes the head to interrupt the path. The interruption may cause an action (e.g., generate a sound associated with a mode of a circular membrane, etc.).

An exemplary device may optionally include a detector on the underside of a drum head to determine if an object contacts the underside of the drum head. Such a detector optionally forms part of an emitter and a detector path associated with the underside of the drum head. Such a device optionally includes any of the features of various exemplary devices described herein, as appropriate. Various exemplary devices include one or more switches that are optionally operated by a hand, a foot, a stick, etc.

An exemplary device optionally includes a switch or button that allows a user to select a preprogrammed instrument and/or sound effect (e.g., via a selection of a memory block, algorithm, etc.). An exemplary transducer may allow for other switches, buttons, etc., for similar or other effects. Consider a "wah-wah" wheel that allows a user to bend pitches, etc. In other examples, a "wah-wah" effect is achieved by moving an object to interrupt one or more emitter/detector radiation paths.

An exemplary device optionally includes a gyroscope and/or an accelerometer. Advances in robotics, for example, have led to more widespread use of gyroscopes and accelerometers. Some drums (e.g., a pandeiro, etc.) may include playing techniques where the position of the drum is changed and/or the drum is banged or hit in, for example, a substantially unsupported manner (e.g., supported only by a hand and not a stand).

Commercially available accelerometers and/or gyroscopes include, for example, the Valu-Line™ Model 7596 MICROTRON accelerometer from ENDEVCO (San Juan Capistrano, Calif.) which uses variable-capacitance microsensors for low-level, comparatively low-frequency measurements that can aid in motion measurements, modal analysis, etc., and the Angular Rate Sensor ADXRS150, which is a 150 deg/sec angular rate sensor (gyroscope) on a single chip, complete with all of the required electronics. This particular gyroscope operates from 5V supply and is available in a 32-pin Ball Grid Array surface-mount package measuring 7 mm×7 mm×3 mm.

Thus, use of an accelerometer and/or a gyroscope may allow for additional control of an exemplary device and/or operate in conjunction with an exemplary device. For example, an exemplary device optionally communicates with and/or includes a computer (e.g., a computing device such as a processor-based device, etc.) that may receive input from a variety of sources. Again, in the case of a pandeiro, certain sounds rely on position of the pandeiro with respect to gravity, dominant hand, etc. A gyroscope may provide such positional information to better approximate sounds and/or allow for more control (e.g., pitch, bend, etc. may be coupled to angle). An accelerometer may provide information germane to sounds and/or allow for more control.

An exemplary device optionally includes wireless communication capabilities (e.g., 802.11b, etc.) and optionally includes remote emitter sources and/or detectors. A "wire" connecting to an exemplary device optionally allows for communication with a computer (e.g., computing device), a power supply for emitters and/or detectors, and/or for transmission of radiation (e.g., a waveguide), etc. In the latter case, such a wire may be a fiber optic cable that optionally includes a plurality of optical fibers capable of transmitting radiation to or from an exemplary device and/or information to or from an exemplary device. An exemplary device optionally includes an interface that allows for acquisition of information (e.g., transfer of information) related to one or more detectors may be a wireless interface, a wired interface, a fiber interface, etc. Such an interface may allow for acquisition of information related to detected radiation.

An exemplary device may include a bus that is optionally a wireless bus or a wired bus. Exemplary buses include parallel and serial buses. An exemplary serial bus is optionally selected from a bus conforming to a Universal Serial Bus standard (e.g., USB 1, USB 2, etc.) or a bus conforming to an IEEE 1394 standard (e.g., FireWire, Apple Corp, Calif.). An exemplary parallel bus is optionally selected from a bus conforming to a PCI standard or a bus conforming to a VME standard.

A bus optionally supplies power to an exemplary device. For example, a serial IEEE 1394b bus (e.g., FireWire 800) may supply up to 45 watts (e.g., 1.5 amps and 30 volts). The IEEE 1394b can also accommodate transfer rates up to approximately 3.2 Gbps and distances up to approximately 100 meters. IEEE 1394b cables include 9-pin shielded twisted pair, CAT-5 unshieled twisted pair (e.g., standard Ethernet cable), step-index plastic optical fiber, hard polymer-clad plastic optical fiber, glass optical fiber, etc.

Buses conforming to USB and/or IEEE 1394 standards are typically used in applications such as digital video and/or digital cameras. For example, the Evolution™ LC digital camera (Media Cybernetics, Inc., Silver Spring, Md.) includes a Zoran CMOS sensor (e.g., 1280×1024) and an IEEE 1394 interface that allows for data transfer rates of 24 MHz at 24-bit. The aforementioned digital camera illustrates how a detector array may be powered and/or transfer information to a computer.

With respect to emitters, an exemplary emitter may include a radiation emitting diode. Further, such radiation may have one or more wavelengths in the visible and/or in an invisible spectrum. Visible wavelengths may generate visible paths that may act as fiducials (e.g., dots, lines, cross-hairs, etc.) to enhance maneuvering of objects with respect to an exemplary device. Diodes or other components that emit radiation in the near-infrared spectrum (e.g., without any substantial emission of visible radiation) may also be used as emitters (e.g., including sources).

With respect to detectors, an exemplary device optionally includes one or more photodiodes. Photodiodes are typically semiconductors that generate a current or voltage when illuminated by radiation. In general, a photodiode is selected based on a variety of factors, such as, wavelength, response time, sensitivity, etc. "High-speed" photodiodes include Fermionics Opto-Technology high speed InGaAs photodiodes for high speed analog and digital communication systems, LANs, FDDI, instrumentation, and sensing applications (e.g., rise/fall times in hundreds of picoseconds ($100\times10^{-12}$ s)). Photodiodes are also available in arrays. For example, iC-Haus GmbH (Bodenheim, Germany) markets a 128×1 linear image sensor that includes 128 active pixels on a chip size of 8.5 mm×1.6 mm. Features include clock rates to 5 MHz (5,000,000 Hz) wherein a run of all 128 active pixels requires 128 clock pulses (approximately 40,000 Hz) and an operating voltage of approximately 5 V. Such an array is optionally suitable for use in an exemplary device, for example, wherein optical fibers communicate radiation from detector locations adjacent to an illuminated volume to a sensor, optionally remote from an illuminated volume.

Of course, additional components may be used to gain velocity information (e.g., time information) in such a situation. For example, an existing system uses infrared emitters and detectors that rely on reflection of radiation from an object. Some of such existing systems have been compared to Theremins (invented in 1919 by a Russian physicist named Lev Termen). In a particular existing system, an emitter radiates a space, an object (e.g., a hand) placed in this space reflects the emitted radiation, one or more detectors receive the radiation reflected from the object and a determination is made based on the reflected radiation (see, e.g., U.S. Pat. No. 6,501,012 to Toba et al., issued Dec. 31, 2002, which is incorporated by reference herein). Any of the various aforementioned arrangements are optionally used in conjunction with such an existing system or a suitable variation thereof (see, e.g., FIG. 19). Hence, an exemplary device optionally includes use of radiation reflected from an implement (e.g., a hand, a mallet, a stick, a brush, etc.) to determine one or more parameters, wherein such one or more parameters are typically related to velocity, acceleration, position, etc., of the implement.

FIG. 9 shows an exemplary user interface that has a window 900 for displaying musical notation. In this example, the notation may be created or edited using information displayed in one or more other windows. For example, a window may display various percussion instruments that optionally appears upon selection of "percussion instruments" from a previous menu or from a menu in another window. A user may select for example "Brazilian percussion instruments" and optionally further "Frevo" related Brazilian percussion instruments. In this example, the user may select a note from a note window (e.g., a quarter note) and then associate the note with an instrument selected from an instrument window. A user may optionally adjust syncopation using "+t" and/or "−t" buttons in the window (e.g., plus time and minus time) and/or otherwise adjust the sound via accents "<", open or closed marks ("o/+", e.g., where one click give open, an additional click closed and another click neither open or closed, optionally a shift or crtl key may be used, etc.), etc. The exemplary user interface optionally includes a frequency adjustment window for sound frequency related to a voice. Various regions or areas of various exemplary devices may be programmed to provide sounds such as those of the percussion ensemble shown in the window 900.

As already mentioned, a user may save one or more settings in memory and may optionally switch from one setting to another or otherwise select settings during playing and/or during a break from playing. As such, a player may play a real instrument (e.g., a drum) and then choose from a rich variety of other instruments which are controlled through use of an exemplary device that is optionally mounted to the real instrument. Of course, an exemplary device may be used alone (e.g., not mounted on or used in conjunction with another instrument). In situations where such an exemplary device is used in conjunction with or combined with a piezoelectric or other electronic percussion instrument, information may be shared between the exemplary device and the electronic percussion instrument. For example, an exemplary device may provide position information while a force sensing resistor-based percussion instrument may provide force and/or other information. Such information is optionally input to a computer which may have a user interface that allows a user to control either equipment and/or integrate various information.

FIG. 10 shows exemplary equations for an exemplary scenario 1000. This scenario illustrates various angles and relationships between an emitter ($E_0$) and a plurality of detectors ($d_0$, $d_1$ . . . $d_N$). In addition, line equations in polar and/or Cartesian coordinates are shown, for example, based on a two point equation for a line. This exemplary scenario also illustrates an outer circle having a radius $r_E$ and an inner circle having a radius $r_{active}$. Of course, other arrangements are possible, for example, where emitters and/or detectors are positioned at or closer to an inner circle, where there is no distinction between an inner and an outer circle, etc.

FIG. 11 shows exemplary equations for an exemplary scenario 1100. The exemplary equations of this exemplary scenario 1100 relied on several theorems for derivation (see, e.g., "Circle Detection Method using the Intersecting Chords", by Kim et al., International Symposium on Robotics and Automation (ISRA 2000), Monterrey, N.L., Mexico, Nov. 10–12, 2000, which is incorporated herein by reference). The exemplary equations are shown for a particular case and modifiable to account for points A, B, C and/or D lying in any of the quadrants of the polar coordinate system.

The motivation for this derivation follows from various exemplary arrangements, devices, systems, methods, etc., that rely on paths between one or more emitters and one or more detectors. For example, when an object (e.g., an object wherein a line drawing between two interior points does not cross an exterior boundary) interrupts two intersecting paths, the position of the object includes the position of the point of intersection. In essence, a path is "selected" when the path is interrupted by an object.

As already mentioned, paths optionally form chords of a circle having a radius, r. Each path has an emitter associated with an azimuthal angle and a detector associated with another azimuthal angle. For example, a first path has an emitter or a detector associated with an azimuthal angle $\Theta_A$ and a detector or an emitter associated with an azimuthal angle $\Theta_C$ and a second path has an emitter or a detector associated with an azimuthal angle $\Theta_B$ and a detector or an emitter associated with an azimuthal angle $\Theta_D$. Thus, in the exemplary scenario 1100, four azimuthal angles are known: $\Theta_A$, $\Theta_B$, $\Theta_C$, and $\Theta_D$. Points associated with these azimuthal angles are assumed to lie on the circumference of a circle having a radius, r, and defined with respect to the origin of the circle. A goal is to find the point where the paths or chords passing between AC and BD intersect.

The derivation may start by determining chord length based on radius, r, and the angles $\gamma_1$ and $\gamma_2$. Then the derivation may determine an apothem for each chord. The first apothem, $r_1$, and the second apothem, $r_2$, form legs of a first right triangle and a second right triangle and, in this exemplary scenario, the sum of the upper angles $\alpha_1$ and $\alpha_2$ of the two right triangles is equal to the angle $\alpha$ between the first apothem and the second apothem. In addition, the two right triangles share a common hypotenuse, $r_p$, which is the radial position of the intersection point. A relationship exists between the ratio of $r_1$ to $r_2$ and, for example, the angle $\alpha_1$, which may be solved for $\alpha_1$. Once $\alpha_1$ has been determined, then $r_p$ may be determined using, for example, $r_1$. Thus, in such a manner, or optionally some other manner, the intersection point may be determined in polar coordinates.

An exemplary method determines the radial position of an intersection between two chords and optionally relates the radial position to a circular membrane. Such an exemplary method optionally determines the radial position and optionally a corresponding azimuthal angle based on five parameters: radius of a circle, $\Theta_A$, $\Theta_B$, $\Theta_C$, and $\Theta_D$, wherein the radial position and/or the azimuthal angle may may be used to cause an action (e.g., sound, sound effect, control action, etc.). An exemplary method optionally determines an azimuthal angle based on four parameters $\Theta_A$, $\Theta_B$, $\Theta_C$, and $\Theta_D$ wherein the azimuthal angle may be used to cause an action (e.g., sound, sound effect, control action, etc.). An exemplary method includes a priori knowledge of position in relation to chord information (e.g., stored in memory, etc.). Accordingly, a rapid determination may be made as to position of an object upon the object interrupting two or more radiation paths wherein each path may be defined as a chord.

The exemplary equations of the exemplary scenario 1100 illustrate how an exemplary method may readily determine a position of an object that interrupts two paths wherein the paths form chords of a circle. Again, in general, the end points of each of the chords in such an example will typically correspond to an emitter and a detector and/or other defined points of a path or ray. Such a method may be modified or adapted to other geometries.

According to various exemplary arrangements, devices, systems, methods, etc., an object may interrupt more than two paths. For example, an object may interrupt three paths. In such instances, a first path and a second path may be used to determine a first position for the object, the first path and a third path may be used to determine a second position for the object, and the second and the third path may be used to determine a third position. The first, second and third positions are optionally averaged to form an average position and/or used to determine an area associated with an object. Once a series of points has been determined, various techniques may be used to determine an area such as techniques known in image analysis. While solutions may exist, for example, for three intersecting chords, in practice, three paths (e.g., chords) may not intersect at exactly the same point when interrupted by an object. Overall, various exemplary arrangements, devices, systems, methods, etc., optionally rely on binary data to determine interrupted paths which may be or may form chords of a circle. One or more positions may then be determined by determining one or more intersection points for intersecting chords.

Figure 12:
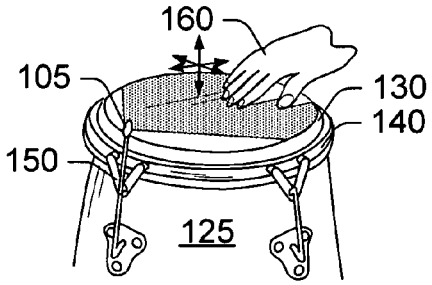
FIGS. 12–19 are perspective view diagrams of various exemplary devices associated with acoustic and/or electronic instruments.

FIGS. 12–19 show various implementations of exemplary arrangements, devices, systems, methods, etc. FIG. 12 shows a perspective view of an exemplary device 105 for creating a visual display that mounts to a drum 120 (e.g., a conga, etc.) and emits visible radiation over a head of the drum. The drum 120 includes a drum head 130, a retainer 140, and a mount 150 for mounting the exemplary device 105 to the drum 120. The mount 150 optionally comprises a mount such as those available for mounting a microphone or a trigger. Such a mount may be modified with an insert or a mount head suited for holding the exemplary device 105. In this example, the exemplary device 105 is an emitter that emits a fan-beam that illuminates a plane over the head of the drum 130. An object 160 (e.g., a hand, etc.) contacting the drum head 130 is illuminated as it enters the emitted fan beam. The object 160 may move in a 3-D space bounded at least partially by the drum head 130. If the object 160 is used to produce sound by intermittently entering the fan beam, then a visual display is created as the radiation reflects off the object 160. In general, such illumination is visible to an observer (e.g., an audience), to thereby allow the observer to visualize timing associated with percussive sound, for example, to visualize rhythm. Such visualization may allow an observer to move, clap and/or dance more effectively with a rhythm. The particular angle at which the exemplary emitter device 105 is mounted may be selected to such that a line is formed between the emitter device 105 and an edge of the drum head 130. In such a manner, the radiation is directed downward. Such an arrangement may act to reduce the amount of radiation that does not terminate at a surface of the drum 120.

Figure 13:
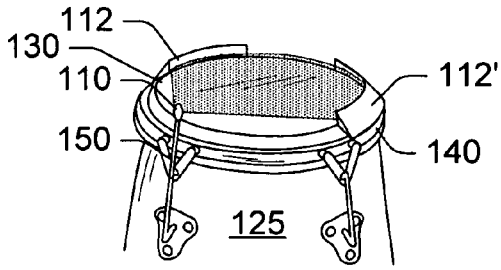

FIG. 13 shows a perspective view of an exemplary arrangement that includes an exemplary device 110 and one or more additional components 112, 112' mounted to a drum 125 (e.g., a conga, etc.). The exemplary device 110 includes an emitter. In this example, the device 110 emits radiation in the form of a fan-beam that substantially defines a plane that is optionally substantially parallel to a head 130 of the drum 125. The drum 125 includes the drum head 130, a retainer 140 and a mount 150 for mounting the exemplary device 110 to the drum 125. While two arc-shaped components 112, 112' are shown, a single arc-shaped component may be suitable. Also, as an alternative, more than two components may be used wherein the components are arc-shaped and/or arranged substantially in an arc around a circumference of the drum head 130.

The components 112, 112' may operate to block radiation emitted by the exemplary device 110 and/or to house detectors sensitive to the radiation emitted by the exemplary device 110 thereby forming interruptible radiation paths. In the latter instance, interruption of a path or paths may cause an action (e.g., sound, sound effect, control action, etc.). The radiation emitted by the exemplary device 110 may be visible and/or invisible radiation (e.g., IR, UV, etc.). Depending on the radiation emitted by the exemplary device 110, an object interrupting the fan-beam may be illuminated in a manner visible to the human eye. In yet another example, an object used to contact the drum head 130 includes a material that illuminates, fluoresces, etc.

Figure 14:
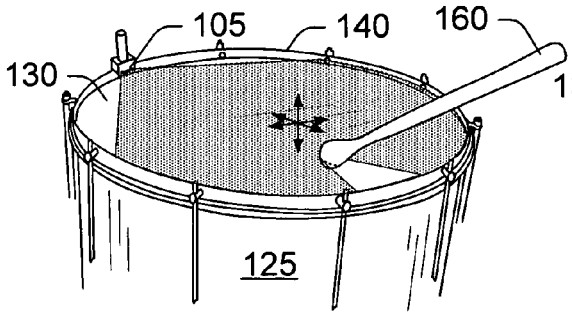

FIG. 14 shows a perspective view of an exemplary device 105 that mounts to a drum 125 (e.g., a tom, a surdo, etc.) and emits visible radiation over a head 130 of the drum 125. The exemplary device 105 includes an emitter. The drum 125 includes the drum head 130, a retainer 140, and a mount 150 for mounting the exemplary device 105 to the drum 120. The mount 150 optionally comprises a mount such as those available for mounting a microphone or a trigger. Such a mount may be modified with an insert or a mount head suited for holding the exemplary device 105. In this example, the exemplary device 105 emits a fan-beam that illuminates a plane over the head 130 of the drum 125. The exemplary device 105 optionally includes a prism or other optical component to direct radiation. For example, a cylindrical laser diode module may emit radiation that reflects off a 90° prism wherein the reflected radiation travels substantially parallel to the drum head 130. In this example, the prism may be supported by a mount that also supports the laser diode module. Such an exemplary device may mount to a retainer wall or other retainer or drum component. In one example, an opening exists in a retainer wall (e.g., a retainer ring) that allows for passage of emitted radiation. In another example, the exemplary device 105 mounts at least partially on an inner side of retainer wall (e.g., side toward playing surface of a drum head).

In FIG. 14, an object 160 (e.g., a hand, a stick, a mallet, etc.) contacting the drum head 130 is illuminated as it enters the emitted fan beam. The object 160 may move in a 3-D space bounded at least partially by the drum head 130. If the object 160 is used to produce sound by striking the drum head 130, then it may intermittently enter the fan beam and create a visual display as the radiation reflects off the object 160. In general, such illumination is visible to an observer (e.g., an audience), to thereby allow the observer to visualize timing associated with percussive sound, for example, to visualize rhythm. Such visualization may allow an observer to move, clap and/or dance more effectively with a rhythm. The particular angle at which the exemplary emitter device 105 is mounted may be selected such that a line is formed between the emitter device 105 and an edge of the drum head 130, the retainer 140 or another component of the drum 125. The emitter device 105 may be mounted to emit a fan-beam substantially parallel to the drum head 130 and in a manner whereby the radiation is directed to an inner circumference of a retaining ring (e.g., the retainer 140).

Figure 15:
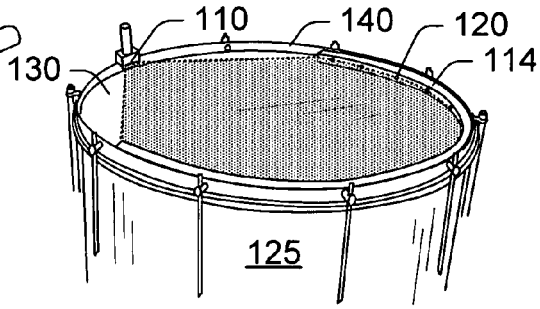

FIG. 15 shows a perspective view of an exemplary arrangement that includes an exemplary device 110 and one or more additional components 114, 120 mounted to a drum 125 (e.g., a tom, a surdo, etc.). The exemplary device 110 includes an emitter. As already mentioned, an emitter optionally includes a source. The drum 125 includes a drum head 130, a retainer 140 and a mount 150 for mounting the exemplary device 110 to the drum 125. While an arc-shaped component 114 is shown, more than a single arc-shaped component may be suitable wherein the components are generally arc-shaped and/or arranged substantially in an arc around a circumference of the drum head 130.

The component 114 includes one or more detectors 120 integral or housed substantially therein wherein at least one of the detectors is sensitive to the radiation emitted by the exemplary device 110 thereby forming one or more interruptible radiation paths wherein interruption of a path or paths may cause an action (e.g., sound, sound effect, control action, etc.). As already mentioned, a detector optionally includes a sensor. The radiation emitted by the exemplary device 110 may be visible and/or invisible radiation (e.g., IR, UV, etc.). Depending on the radiation emitted by the exemplary device 110, an object interrupting the fan-beam may be illuminated in a manner visible to the human eye. In yet another example, an object used to contact the drum head 130 includes a material that illuminates, fluoresces, etc., in a manner responsive to radiation emitted by the exemplary device 110.

Figure 16:
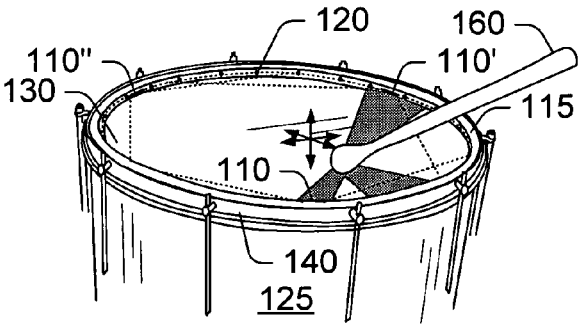

FIG. 16 shows a perspective view of an exemplary device 115 that includes three emitters 110, 110', 110" and one or more detectors 120. The emitters 110, 110', 110" and/or detectors 120 are optionally integral or housed substantially within the device 115. At least one of the detectors is sensitive to the radiation emitted by at least one of the three emitters 110, 110', 110" to thereby form one or more interruptible radiation paths wherein interruption of a path or paths may cause an action (e.g., sound, sound effect, control action, etc.).

The exemplary device 115 mounts to a drum 125 (e.g., a tom, a surdo, etc.) and optionally serves as a retainer. In one example, an exemplary device operates as a retaining ring for a drum head which may be used to tension a drum head. An exemplary device may include a material of construction such as metal (e.g., aluminum, steel, etc.), plastic (resin, etc.), wood (hard wood, etc.), etc., and of substantially rigidity when also used to tension a drum head. The drum 125 includes a drum head 130, a retainer 140 and a mount 150 for mounting the exemplary device 110 to the drum 125.

The exemplary device 115 is optionally integral to the retainer 140 or mounts to the retainer 140. While FIG. 16 shows the device 115 associated with the retainer 115, an exemplary device may mount to a drum head and/or one or more other components of a drum. An exemplary device may mount to a drum without contacting a head of the drum.

While a substantially cylindrical-shaped or ring-shaped device 115 is shown, more than a single component may be suitable wherein the components are generally arc-shaped and/or arranged substantially in an arc around a circumference of the drum head 130. The radiation emitted by the emitters 110, 110', 110" may be visible and/or invisible radiation (e.g., IR, UV, etc.). Thus, a combination of visible and invisible radiation may be used. Depending on emitted radiation, an object 160 interrupting one or more fan-beams may be illuminated in a manner visible to the human eye. In yet another example, the object 160 used to contact the drum head 130 includes a material that illuminates, fluoresces, etc., in a manner responsive to radiation emitted by at least one of the emitters. FIG. 16 shows the object 160 interrupting radiation emitted by the three emitters 110, 110', 110" and casting shadows, which may or may not be visible to the human eye. The object 160 may move in a 3-D space bounded at least partially by the drum head 130. In this example, the device 115 can allow for tracking movement of the object 160 as it interrupts various radiation paths. Speed of up and down motion may be detected where an axial spacing exists between two interrupted paths. Side-to-side motion may be detected where a change occurs in interrupted paths. Speed of side-to-side motion may be detected up knowledge of distance and time between two interrupted paths. In one example, speed of downward interruption is associated with a strike property (e.g., force, velocity, etc.) and speed of side-to-side motion is associated with a sound effect (e.g., change in pitch, change in velocity, change in decay, etc.). Such properties may be selected from MIDI protocol-based and/or other conventional sound control techniques. In one example, a region defined by one or more interruptible radiation paths acts to control the device 115 (e.g., on/off, master volume, active radiation paths, etc.).

Figure 17:
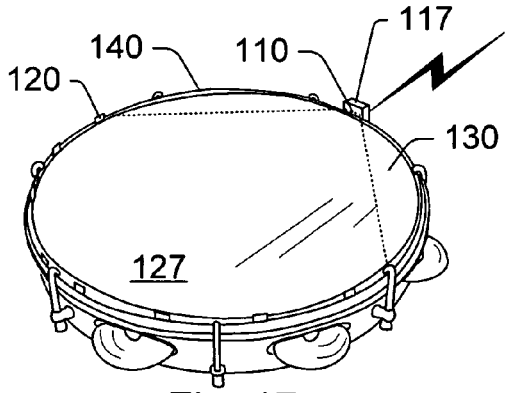

FIG. 17 shows a perspective view of an exemplary arrangement that includes an exemplary device 117 and associated detectors 120 positioned around a head 130 of a typically hand held drum 127. The drum 127 includes a retainer 140. In this example, the detectors 120 are mounted to the retainer 140 and wired to the device 117, which includes one or more emitters 110. At least one of the detectors 120 is sensitive to the radiation emitted by the exemplary device 117 to thereby form one or more interruptible radiation paths wherein interruption of a path or paths may cause an action (e.g., sound, sound effect, control action, etc.). As in various other examples, one or more wires (e.g., a harness, a bus, a cable, etc.) may be optionally mounted to the retainer 140 to allow detector signals to reach the device 117. In one example, the emitter 110 emits two substantially parallel beams and the detectors are positioned at two different axial levels (e.g., optionally two detectors are positioned at an azimuthal angle and at different axial levels to form two interruptible paths). This particular parallel beam or path arrangement may allow for time difference determinations when an object interrupts a path at one axial level and a path at another axial level. The device 117 may include a larger portion, not shown, that fits to the side and/or underneath the head 130 of the drum to house electronics. The device 117 may communicate in wirelessly to a base such that information from interruption of a radiation path is communicated to the base, which may then produce a sound, a sound effect, etc.

Figure 18:
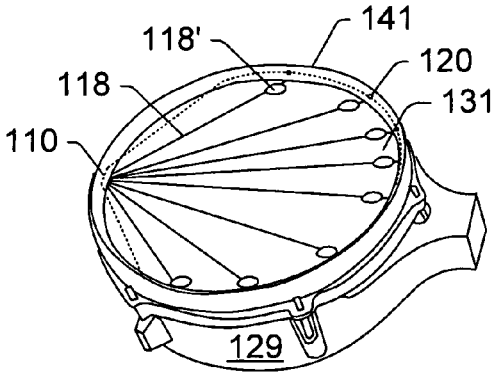

FIG. 18 shows a perspective view of an exemplary arrangement that includes an emitter 110 and detectors 120 and a conventional electronic drum 129. In this example, the drum 129 includes a drum surface 131 (e.g., an electronic head) and a rim 141, somewhat similar in shape to a conventional retainer. The drum surface 131 includes indicia 118, 118' to allow a user to more readily identify radiation paths (e.g., the indicia 118) and/or suitable control regions (e.g., the indicia 118'). Interruption of one or more emitter/detector paths may operate to produce sound, sound effects and/or control operation of the electronic drum 129. While this arrangement includes one emitter, other exemplary arrangements may include more than one emitter, etc. and may include other features, components, etc. Roland Corporation (Osaka, Japan) markets an electronic drum (also referred to as an electronic percussion pad), that includes a sensor mechanism for more triggering. For example, The Roland 10-inch PD-105BK mesh V-Pad features dual-triggering technology and rim shot capabilities on the toms that can produce a rim shot sound. Many electronic drum products use force sensing resistors (commonly known as FSRs). FSRs are commercially available from companies such as Interlink Electronics (Camarillo, Calif.) and an exemplary device may optionally include an FSR and/or operate in conjunction with an FSR.

FIG. 19 shows a perspective view of the exemplary arrangement of FIG. 18 further including a reflection-based system 155. Such a system is optionally used with any of a variety of exemplary arrangements, devices, systems, methods, etc., disclosed herein. The system 155 may detect an object 160 (e.g., a hand or other object capable of sufficiently reflecting radiation) and information related to distance and/or distance with respect to time of the object 160 with reference to the system 155. Information obtained through use of the system 155 may be used in conjunction with information from interruption of one or more radiation paths. For example, in a MIDI environment, the system 155 may provide a strike velocity while interruption of one or more radiation paths provides a note.

With respect to drum sets (e.g., trap sets, etc.), one or more drums (whether acoustic or electric) may include an exemplary arrangement, device and/or system. Such an exemplary arrangement, device and/or system may implement various exemplary methods or other methods that may allow for control of sound, sound effects, etc., for one or more drums. In one example, a drum set includes a floor bass drum and a tom drum wherein the tom drum includes an exemplary device. Various exemplary arrangements, devices and/or systems optionally include foot operated switches, controllers, etc.

Figure 20:
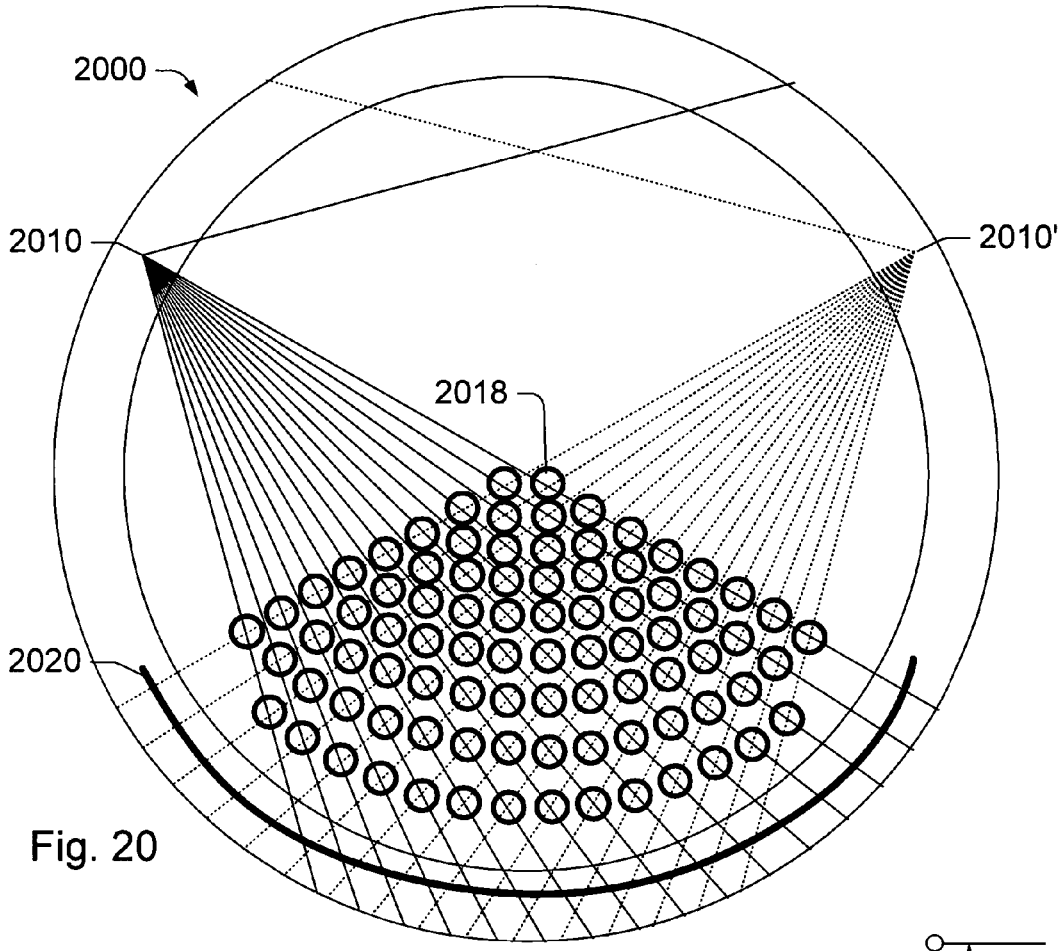
FIG. 20 is a diagram of an exemplary device and exemplary indicia.

FIG. 20 shows an exemplary arrangement 2000 that includes indicia 2018 (e.g., about 86 circular indicia) wherein each indicium indicates an intersection of two radiation paths, one path associated with one emitter 2010 and another path associated with another emitter 2010'. The exemplary arrangement 2000 also includes a detector array 2020. The indicia 2018 may facilitate operation of an exemplary device based on such an exemplary arrangement 2000. The indicia 2018 may be projected onto a surface (e.g., from above and/or from below), marked on a surface, be integral with a surface, etc. The indicia 2018 may change, be adjusted, represented etc., with respect to a change in operation of radiation paths. Software for programming a programmable exemplary device may allow for generation or printing of an indicia template or image. Exemplary indicia may include dye and optionally dye that fluoresces or otherwise interactions with radiation to become more visible to the human eye. Various other exemplary arrangements may include sparser and/or denser radiation paths regions. Indicia may be of any particular shape, form, etc.

Figure 21A:
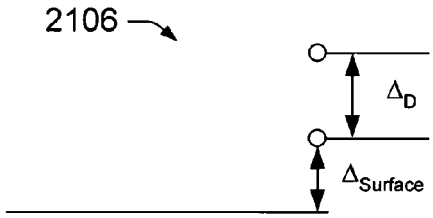
FIG. 21A shows an exemplary two level arrangement of detectors and FIG. 21B shows an exemplary three level arrangement of detectors.
Figure 21B:
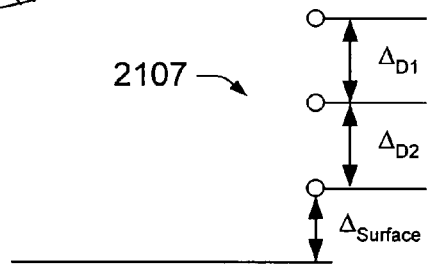

FIG. 21A shows an exemplary two level (e.g., axial level along a z-axis normal to a surface) arrangement of detectors 2106 and FIG. 21B shows an exemplary three level (e.g., axial level along a z-axis normal to a surface) arrangement of detectors 2107. The arrangement 2106 includes a $\Delta_D$ and a $\Delta_{Surface}$ while the arrangement 2107 includes a $\Delta_{D1}$, a $\Delta_{D2}$ and a $\Delta_{Surface}$. These distances may be used to account for speed and/or velocity of an object entering an exemplary device and/or other timing of events and/or actions. For example, a Speech, Music and Hearing, Quarterly Progress and Status Report (TMH-QPSR 4/1997) entitled "Measurements of the motion of the hand and drumstick in a drumming sequence with interleaved accented strokes—a pilot study" by Dahl, which is incorporated by reference herein, states that for "accented strokes", "impact velocity of the tip [of a drumstick] reaches about 13 m/s, compared to 1 m/s for the soft strokes" and that "these values correspond to about twice the hammer velocity at string impact in pianos at ff and pp respectively". While some drummers may exceed a tip velocity of 13 m/s, this value may be used in determining various parameters such as $\Delta_D$, $\Delta_{Surface}$, etc. For example, at a drumstick tip speed of 13 m/s and a $\Delta_D$ of about 0.001 m (e.g., about 1 mm), the tip may interrupt the two detectors with a time difference of about (0.001 m)/(13 m/s) or about $7.7\times10^{-5}$ seconds (e.g., $\Delta t_D \sim 8\times10^{-5}$ s). For a $\Delta_{Surface}$ of about 0.003 m (e.g., about 3 mm), assuming no substantial increase in speed, the tip may strike the surface at about $2.3\times10^{-4}$ seconds (e.g., $\Delta t_{Surface} \sim 2\times10^{-4}$ s) after passing the lower detector. Adjustment of one or both detector level with respect to the surface can alter this time for the given tip speed. An exemplary method optionally accounts for a $\Delta t_{Surface}$ value based on a $\Delta t_D$ value and/or other parameter value. For example, if an exemplary device includes a latency of about 0.002 seconds (e.g., about 2 ms), a $\Delta_D$ or about 0.001 m and a $\Delta_{Surface}$ of about 0.003 m, then a soft stroke of 1 m/s may be expected to have a $\Delta t_{Surface}$ of about 0.003 seconds (e.g., about 3 ms). In this particular example, the exemplary device latency (e.g., about 2 ms) is less than the $\Delta t_{Surface}$ (e.g., about 3 ms); hence the exemplary device may act (e.g., produce a sound, etc.) before the tip strikes the surface. An exemplary method optionally uses a delay to account for such "negative latency". Such an exemplary method may aim to operate at a target latency, which may be zero, positive or negative. Such a delay may be variable or constant and/or adjustable.

Figure 22:
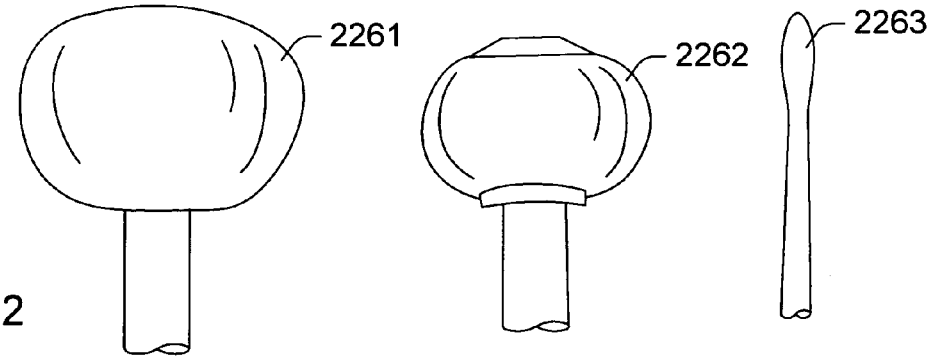
FIG. 22 is a diagram of various implements typically used for percussion (e.g., acoustic, electronic, etc.).

FIG. 22 shows heads or tips of various implements 2261, 2262, 2263 typically used in drumming. The implement 2261 may be a tympani or other mallet with a natural fiber and/or synthetic fiber head; the implement 2262 may be a tympani or other mallet with a natural fiber and/or synthetic fiber head; and the implement 2263 may be a conventional drumstick (e.g., as used in the aforementioned report). The heads and/or tips are shown approximately in relative size to indicate that head/tip size can vary. Brushes or other implements may optionally be used and/or accounted for. In one example, an exemplary device operates as a virtual steel drum that is optionally mounted to an acoustic or electronic drum. Various regions within an emitter/detector path space of the virtual steel drum optionally respond in a manner associated with a real steel drum. Such regions may be marked by indicia (e.g., polygons, circles, etc.). In another example, an exemplary device operates as a virtual tympani drum. In yet another example, an exemplary device operates as a virtual keyboard (e.g., piano, organ, marimba, xylophone, etc.) that optionally mounts to an acoustic and/or electronic drum.

Figure 23A:
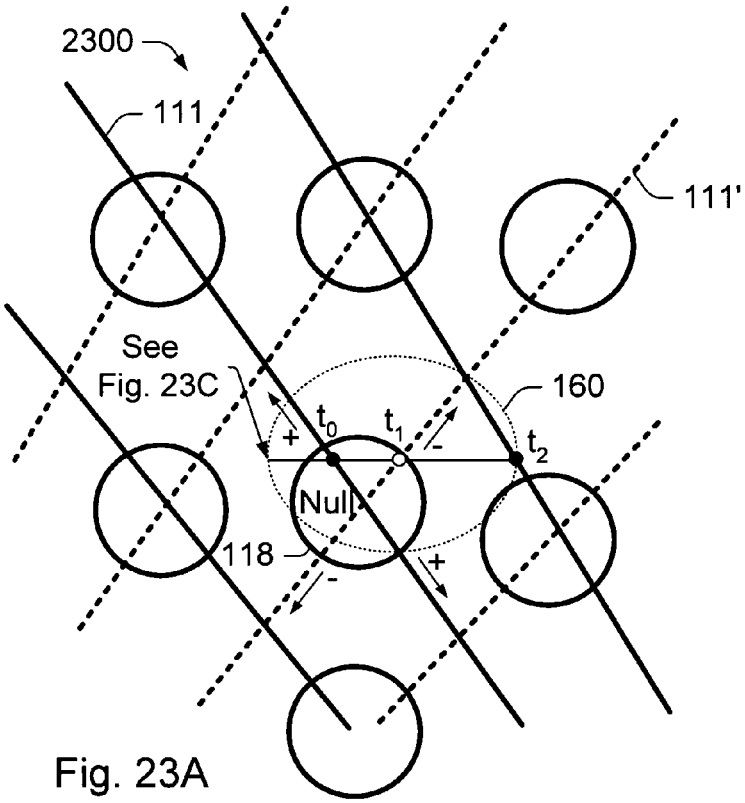
FIGS. 23A–23C are diagrams of an exemplary arrangement and an exemplary method of control.

FIG. 23A shows a portion of an exemplary arrangement 2300 such as the arrangement 2000 of FIG. 20. The arrangement 2300 includes upper interruptible paths 111 associated with a first emitter and lower interruptible paths 111' associated with a second emitter. Indicia (e.g., indicium 118), which are generally optional, are also included in the arrangement to indicate intersection in the 2-D view of FIG. 23A, noting that in the arrangement 2300 a $\Delta_D$ exists between paths at various intersection points. Further, in the exemplary arrangement 2300, the $\Delta_D$ are substantially the same for the intersection points shown. In various other exemplary arrangements, $\Delta_D$ may vary. The description of the exemplary arrangement 2300 can depend on implement head or tip size. Further, the nature of any particular "intersection point" may differ with in an arrangement, for example, depending on arrangement of emitters and detectors. Thus, the description of the exemplary arrangement 2300 may be viewed as illustrative of an exemplary analysis for a particular arrangement and applicable in varying degrees to other exemplary arrangements.

Figure 23B:
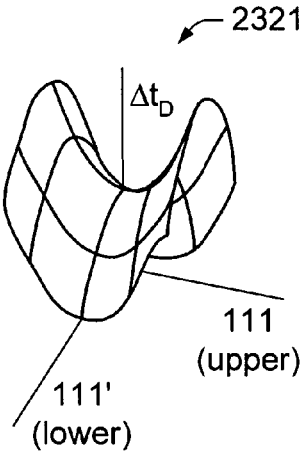
Figure 23C:
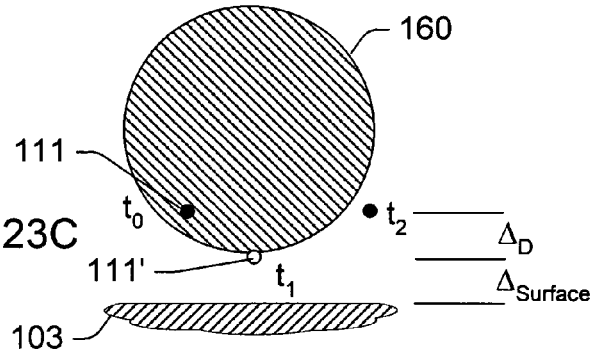

A dashed oval-shaped line indicates an implement 160 that can interrupt one or more of the paths 111, 111' (see, e.g., FIG. 22). FIG. 23B shows an approximate 3-D plot 2321 of $\Delta t_D$ versus position along the upper path 111 and position along a lower path 111' for the intersection corresponding to the indicium 118. Arrows along the paths 111, 111' correspond to the approximate plot 2321. In this example, $\Delta t_D$ increases for strikes off-center of the intersection and along the upper path 111 and $\Delta t_D$ decreases when for strikes off-center of the intersection and along the lower path 111'. FIG. 23C shows a cross-sectional view of a part of the exemplary arrangement 2300 wherein the object 160 interrupts the path 111 at a time $t_0$ and interrupts the path 111' at a time $t_1$ wherein $\Delta t_D$ is $t_1 - t_0$. In this example, a surface 103 is present. If the cross-section included the intersection point, then the path 111 and the path 111' would be shown as lying along a vertical line. In the 3-D plot 2321, the intersection of the path 111 and the path 111' appears substantially as a "saddle point". A user may rely on such knowledge or gain such experience using an exemplary device that has an exemplary arrangement such as the exemplary arrangement 2300. For example, if $\Delta t_D$ corresponds to a sound intensity (e.g., volume) and if a user desires to strike the surface 130, which may be a head of a drum, and produce a sound associated with the intersection point of the path 111 and the path 111' (e.g., per the indicium 118) then the user may produce the sound at different sound intensities by deciding to applying strikes of substantially the same velocity at points off-center of the intersection point. In another example, $\Delta t_D$ corresponds to a pitch bend or other sound effect. In this manner, the drum sound produced by the drum head may remain relatively constant while an electronically produced sound may vary from strike to strike, for example, per the plot 2321. Such a variation may be different than a variation achieved by interrupting paths associated with a different intersection point. For example, each intersection point may correspond to a different note (e.g., C, C#, D, D#, E, F, etc.), a different instrument, etc.

The analysis for FIGS. 23A, 23B and 23C may vary depending on path spacing, path density, size of implement head or tip, etc. For example, a dense path region may be defined as active planar path spacing less than half a head or tip dimension and a very dense path region may be defined as active planar path spacing less than one-quarter a head or tip dimension. In some instances, a path may exist but have no actual control associated with interruption of the path; thus, a dense path region may be programmed or otherwise adjusted to operate at a lesser density (e.g., every other path active, etc.). In some instances, less than all path intersections are associated with an action.

Figure 24:
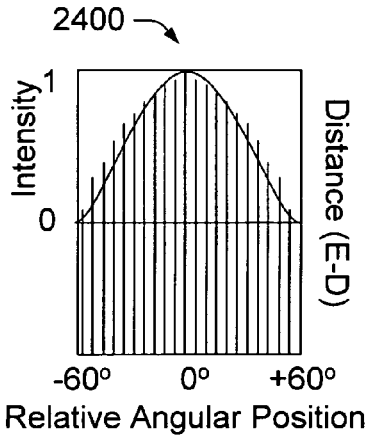
FIG. 24 is a plot of substantially Gaussian emission intensity with respect to angle of emission for an exemplary fan-beam.

FIG. 24 shows a plot 2400 of relative angular position (see, e.g., $\Delta\Theta_E$) versus intensity and path length between a detector and an emitter that emits a beam with a substantially Gaussian intensity distribution for a fan-beam with a 120° fan angle (e.g., $\Delta\Theta_E$~120o or $\Theta_E$~−60° to +60°). While various emitters can emit a fan-beam with a substantially constant intensity over a fan angle, others emitters emit a fan-beam with a somewhat Gaussian intensity distribution over a fan angle (e.g., when projected onto a flat surface normal to the beam axis). Such a distribution may arise from optics and/or the fact that a path between an emitter and a flat surface is typically shortest straight on and increases at the extrema of the fan angle. Detectors may be adjusted (e.g., physically, electronically, etc.) to account for such variations in intensity. In general, an arrangement that includes projecting a fan-beam on an arc results in emitter to detector paths that vary in a somewhat Gaussian manner. For example, the plot 2400 indicates that a 120° fan-beam (+/−60° relative angular position or $\Theta_E$) can project an arc with an arc angle of approximately 240° with respect to the arc focus (e.g., Θ). As shown in the plot 2400, the path lengths vary wherein the longest path length corresponds to the highest beam intensity and the shortest path lengths correspond to substantially lower beam intensities. Thus, as beam intensity decreases with respect to path distance, in such an exemplary arrangement, emitter to detector path distances are matched to emitter intensity distribution in a manner that reduces effects of a Gaussian intensity distribution and/or other factors that may cause a decrease in beam intensity as fan angle increases (e.g., towards $+\Theta_{EMax}$ or $-\Theta_{EMax}$) for a given fan angle.

Figure 25:
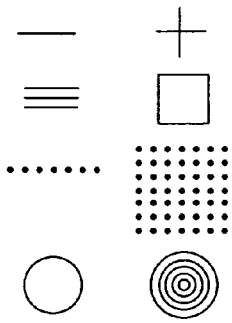
FIG. 25 is a diagram of exemplary emission patterns.

FIG. 25 shows various radiation patterns, for example, as discussed with reference to optical elements, emitters, sources, etc., above. The exemplary radiation patterns include dots, arrays of dots, multiple lines, circles, squares, and crossed lines.

Figure 26:
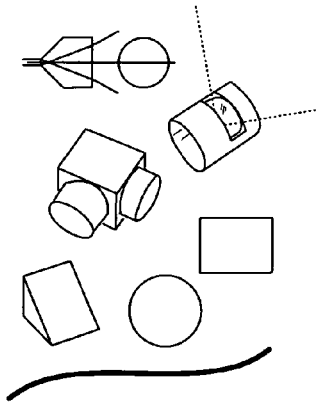
FIG. 26 is a diagram of various exemplary components for altering, communicating adjusting, directing, etc., radiation.

FIG. 26 shows various components suitable for use in various exemplary arrangements, devices, systems, methods, etc. The exemplary components include a line generating lens (shown in cross-section at top), an elbow with two fittings and another elbow, a prism, a curvilinear mirror, a rectangular mirror, and a fiber (at bottom). The company StockerYale markets various elbows to direct a beam at an angle of approximately 90°. Such elbows may direct a fan-beam perpendicular to an emitter and/or source axis wherein the fan fans parallel to the axis or perpendicular to the axis. Such elbows are optionally used to arrange an emitter and/or source with respect to a surface. For example, such elbows may be used to arrange a cylindrical source tangential or perpendicular (e.g., up or down) to a circumference of a drum. Of course, other arrangements are possible using elbows or other components. Emerging and/or reflected radiation from a component may be cause the component to be considered an emitter, for example, for purposes of defining an emitter/detector radiation path. With respect to detectors, a region where radiation enters or illuminates a component may be considered a detector, for example, for purposes of defining an emitter/detector radiation path.

FIG. 27A shows a top view of an exemplary device 2700 that indicates approximate positions of various detectors and emitters. Numbers surrounding the device correspond approximately to degrees. The radiation paths of the exemplary device 2700 may lie substantially in a single plane or lie in different planes. In the latter instance, two or more of the planes are optionally parallel. FIG. 27B shows a front view of an exemplary arrangement 2790 that may be defined with reference to three planes: a plane associated with a detector D1, a plane associated with an emitter E2 and a plane associated with a detector D3. Dashed lines show locations that may be occupied by various components (e.g., emitter, detector, etc.) while thicker dashed lines indicate a bus for signals and/or power. For example, a laser diode may include a cylindrical package oriented along an emitter plane and appear circular while a detector/sensor may include a cylindrical package oriented perpendicular to a detector plane and appear rectangular in a side view. The exemplary arrangement may correspond to angles of about 30°, 150° or 270° of the top view of FIG. 27A. FIG. 27B also shows a top view 2792 that illustrates exemplary locations of the detector D1, the emitter E2 and the detector D3 as well as approximate passages from an inner circumference to the detectors D1 and D3 and an approximate path from the emitter E2 to the inner circumference. FIG. 27C shows a front view of an exemplary arrangement 2794 that may be defined with reference to three planes: a plane associated with a detector D1, a plane associated with a detector D2 and a plane associated with a detector D3. Dashed lines show locations that may be occupied by various components (e.g., detector, etc.) while thicker dashed lines indicate a bus for signals and/or power. The exemplary arrangement may correspond to angles of about 90°, 210° or 330° of the top view of FIG. 27A. FIG. 27C also shows a top view 2796 that illustrates exemplary locations of the detector D1, the detector D2 and the detector D3 as well as approximate passages from an inner circumference to the detectors D1, D2 and D3. Angle-of-view created by such passages may act to reduce consequences of stray radiation (e.g., ambient or other unwarranted radiation).

Figure 28:
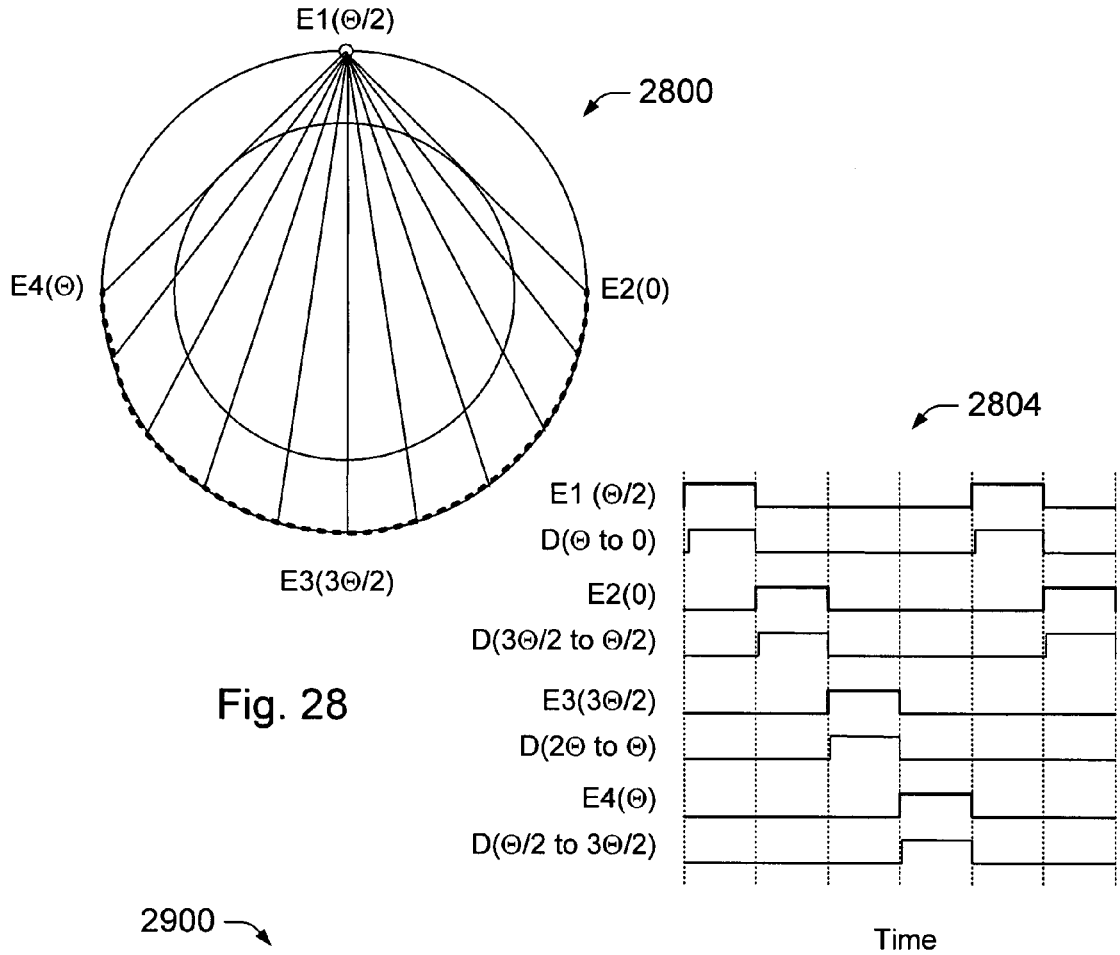
FIGS. 28–29 are diagrams of exemplary arrangements and exemplary timing sequences.

FIG. 28 shows an exemplary arrangement 2800 that includes four emitters (E1, E2, E3, E4) arranged at approximately 90° increments about a central axis and capable of projection radiation toward the central axis. An exemplary timing sequence is also shown 2804. In this example, detectors are positioned radially about the axis. An exemplary method includes pulsing or switching on one or more emitters and then acquiring information from the detectors to determine if an object has interrupted a path between detectors capable of detecting radiation emitted from the switched on emitters. In one example, emitter 1 (E1) is pulsed and all or some detectors read (note that a small delay may exist between pulsing an emitter and acquiring information from one or more detectors to account for a rise time and/or other latencies). Next, emitter 2 (E2) is pulsed and all or some detectors read and so on for emitter 3 (E3) and emitter 4 (E4). In this manner, a tomographic approach is achieved which has advantageous anti-aliasing capabilities. In general, aliasing decreases as the number of projections increases. Pulsing may be achieved through circuitry such as that conventionally used to pulse emitters (e.g., TTL or other). Shutters or other mechanisms may be used to achieve switching on and off of the emitters.

In this particular example, an array of detectors arranged substantially at a radius about an axis may be used in conjunction with a plurality of switchable or pulsable emitters. In another example, detectors may be positioned at more than one axial position and/or more than one radius. In one example, an exemplary arrangement with four emitters pulses opposing emitter pairs wherein a first emitter pair corresponds to a first axial position and a second emitter pair corresponds to a second axial position. If the emitters are positioned opposite each other and emit fan-beams wherein the fan angle is about 90° or less, then the emitters of a given emitter pair may not illuminate any common detector where the detectors are arranged at a radius about the axis at a given axial position. For example, for a first pair of opposing emitters that emit 90° fan beams, each emitter may illuminate a 180° arc at a radius about a central axis wherein detectors are arranged about the arc while for a second pair of opposing emitters that emit 90° fan beams, each emitter may illuminate a 180° arc at a radius about a central axis wherein the detectors are arranged about the arc. With respect to the second pair, the respective 180° arcs will be substantially orthogonal (e.g., with respect to $\Theta_{Ecenter}$ of the emitters) to the respective 180° arcs of the first pair of emitters. In another example, each emitter emits a characteristic frequency of radiation and the detectors may respond to and/or distinguish radiation based on frequency.

Figure 29:
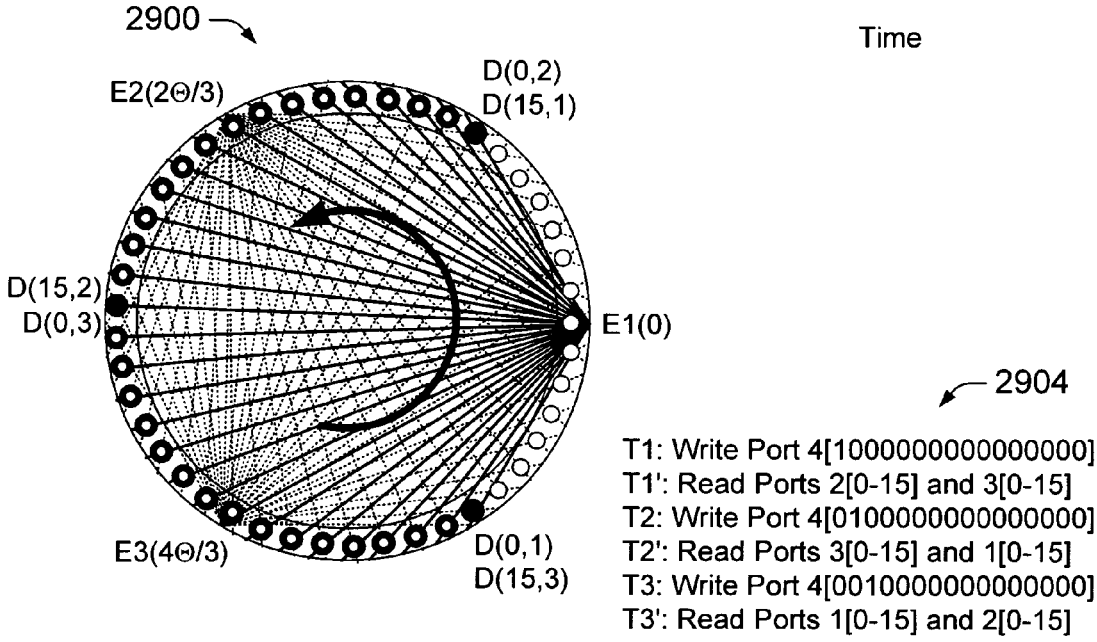

FIG. 29 shows an exemplary arrangement 2900 that includes emitters and detectors. The arrangement includes 45 detectors wherein 42 of the detectors detect radiation from two emitters and three of the detectors detect radiation from all three of the emitters. Solid circles mark the three detectors also note that detectors corresponding approximately to the three emitter positions may optionally be omitted, offset and/or rely on optical components, such as, but not limited to, beam splitters, mirrors, prisms, etc. The detectors marked by thick circles correspond to those to receive radiation emitted by the emitter E1. Solid lines mark radiation paths for E1 while dashed lines mark radiation paths for E2 and E3. An exemplary method optionally relies on fewer than all emitters and/or fewer than all detectors, which may be a selectable option (e.g., automatically and/or manually).

In this example, one or more digital input ports acquire information from the detectors while the emitters are controlled by a digital output port. For example, consider a United Electronics, Inc. (Canton, Mass.) PDL-DIO-64 card that includes four groups of 16 I/Os or a PD2-DIO-128 that includes eight groups of 16 I/Os. One port may output control signals (e.g., TTL) and/or power to power emitters while the other three ports may acquire information from the detectors. In this particular example, the three detectors that detect radiation from all three of the emitters are configured to allow for information acquisition by two ports. For example, the detector labeled D[15,3] and D[0,1] corresponds to the 16th detector of port 3 and the first detector of port 1. Overall, this example demonstrates that only two ports need to be read (e.g., information acquired) for every instance that an emitter is pulsed or switched on. While circuitry from United Electronics, Inc. is mentioned, other circuitry and/or software may be used to perform such an exemplary method. In this example, the timing sequence indicates a counter-clockwise direction for the emitters; clockwise, crisscross or other sequences may be used. Emitters may optionally be pulsed in groups of two or more. Duration of an object in the volume defined by the various emitters and detectors may be used as a control variable and related to a particular action (e.g., sound, sound effect and/or control action).

FIGS. 30–34 correspond in part to various demonstration examples; noting that other equipment, arrangements, etc., may be used. FIGS. 30A and 30B show a front view and a side view of an exemplary detector 120. In this example, the detector 120 corresponds to a light-to-voltage device available from TAOS, Inc. (Plano, Tex.) having part number TSL252R. This particular device has a sensor with an area of approximately 0.26 $mm^2$. The rise time for the device is approximately $7\times10^{-6}$ s for radiation at a wavelength of about 635 nm. As shown in FIG. 30A, the detector 120 has a width of approximately 4.8 mm and a height of approximately 4.8 mm. The detector 120 includes three leads for ground, supply voltage and output voltage. The side view of FIG. 30B indicates that the detector 120 has a depth of approximately 2.6 mm and a substantially hemispherical window with a diameter of approximately 1.8 mm.

Figure 31:
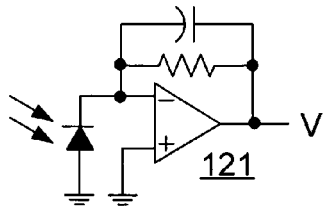
FIG. 31 is an approximate circuit diagram for the exemplary component of FIGS. 30A–30B.

As a light-to-voltage device, this particular detector 120 is suitable for converting illumination intensity to a voltage value. FIG. 31 shows an approximate circuit diagram 121 for performing the converting. The product specifications from TAOS, Inc. for TSL light-to-voltage devices are incorporated herein by reference, which include IR sensitive light-to-voltage devices as well (e.g., TSL262R). The TAOS, Inc. TSL devices include a photodiode and a transimpedance amplifier on a single monolithic IC. While this particular demonstration example used the TSL252R device as a detector, other detectors may be suitable and used to achieve a digital output (e.g., TTL) and/or analog output. Such detectors typically include one or more sensors sensitive to changes in intensity of emitted radiation and/or other radiation. Such detectors may include additional features such as, but not limited to, a lens, a filter, a fiber, etc.

Figure 32:
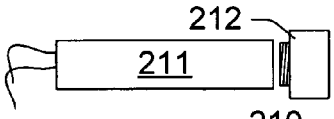
FIG. 32 is a diagram of an exemplary emitter module used in various demonstrations.

FIG. 32 shows a side view of an exemplary emitter assembly 210 that includes an emitter 211 and optics 212 (e.g., lens, etc.). In this example, the emitter assembly 210 corresponds to a LT-Series Laser Diode Module with LO-90 Line Generating Optics available from The Lasermate Group, Inc. (Pomona, Calif.). The LT-Series lasers emit at a wavelength of approximately 650 nm and are powered by a supply voltage in a range from approximately 4.5 V to approximately 6 V. The power output of such a LT-Series laser is approximately 3 mW to approximately 5 mW. The LT-Series laser has a substantially cylindrical shape with a diameter of about 1.27 cm and a length of about 5 cm. The LT-Series laser is focusable. The LO-90 line generating optics generates a fan-beam having a fan angle of approximately 90°. At a distance of approximately 24 cm, when focused, the LT-Series laser and LO-90 optics produced a line with a line thickness of less than approximately 1 mm (5.26 VDC supply from 1000 mA AC/DC converter). The emitted beam can be directed to the window of the detector 120 of FIGS. 30A and 30B. While this particular demonstration example relies on a fairly narrow line thickness, other examples may use emitters and/or emitter assemblies that emit a thinner line, a thicker line or other shape, for example, consider the aforementioned optics for emitting more than one line, a circle, a matrix, etc. Some optics may allow for emission of interference patterns wherein spots, lines, line segments, etc., correspond to interference node and antinode patterns, etc. Such examples may allow for directing energy to detectors in a more efficient manner.

Figure 33:
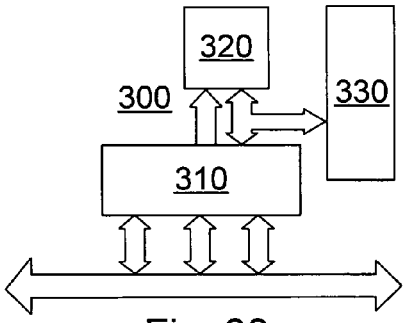
FIG. 33 is a block diagram of an exemplary input and output card used in various demonstrations.

FIG. 33 shows a block diagram of an exemplary input/output device 300. In this particular demonstration example, the input/output device is a PDL-DIO-64ST digital input/output device available from United Electronic Industries, Inc. (Canton, Mass.) ("UEI"). The PDL-DIO-64ST device has 64 digital I/Os arranged in four groups of 16. Referring to the block diagram of FIG. 33, a block 330 represents the 64 I/O ports, a block 320 represents the PowerDAQ digital control and timing logic, a block 330 represents various features of the PDL-DIO-64ST device. For example, the PDL-DIO-64ST device includes four IRQs, three timers, a bus master PCI interface, a Motorola 66 MHz DSP 56301, an ESSI, a DIO clock, a 6 channel DMA, a 12 k program RAM, bootstrap ROM, a DIO FIFO and other features. Address information and a local data bus connect the digital control and timing logic block 320 and the block 310 while a local data bus connects the I/O ports block 330 and the blocks 320, 330. A PCI bus allows for communication with one or more other devices. The PDL-DIO-64ST includes a data streaming capabilities. While a device with I/O ports is used in this demonstration example, which thereby allows input and/or output to the associated emitters and detectors, various other examples may rely on an device with input ports for acquiring information from detectors and another manner/device for controlling emitters (e.g., on/off switches, clocks, etc.).

Figure 34:
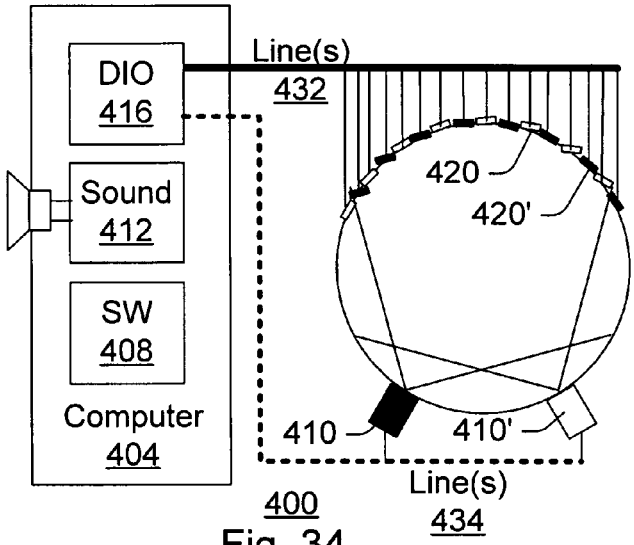
FIG. 34 is a diagram of an exemplary system that includes an exemplary device.

FIG. 34 shows a block diagram 400 for the exemplary demonstration example. A computer 404 includes a software block 408, a sound block 412 and a DIO block 416 (various other components not shown, e.g., mouse, etc.). FIG. 34 also shows two emitters 410, 410', optional emitter control lines 434 that may connect to the DIO block 416, an array of detectors 420, 420' and detector information acquisition lines 432 that connect to the DIO block 416. In a demonstration example, a plastic ring of about 25 cm diameter was used to mount various emitters and detectors. In this particular demonstration example, a Dell C610 Latitude computer served as the computer 404, Visual Basic 6.0 (Microsoft Corporation, Redmond, Wash.) ("VB") served as part of the software block 408, a Sound Blaster Audigy 2 ZS Platinum Pro sound card (Creative Labs, Inc., Milpitas, Calif.) served as the sound block 412 (an alternative sound block was the computer's built in sound chip) and the UEI PDL-DIO-64ST digital I/O card served as the DIO block 416. While labeled a DIO block, this particular block may be or include an analog input block. As an analog input block, an analog-to-digital converter (ADC) may allow for conversion of analog signals to digital data and/or signals. The Dell computer of this example was used in conjunction with a docking station which received the PDL-DIO-64ST and Audigy 2 ZS Platinum Pro cards. The Dell computer included a 1.2 GHz Pentium III processor and 512 MB RAM and the WINDOWS® XP Professional SP1 operating system (Microsoft Corporation, Redmond, Wash.).

Software from UEI was also used, which included the PowerDAQ software suite and a program PD2DIOSingleShot.vbp, which was modified for purposes of this demonstration example. The following references from UEI are incorporated by reference herein: PowerDAQ PD2/PDL/PDXI-DIO, PCI/PXI High-Density Digital I/O Board User Manual, March 2002 Edition and PowerDAQ Programmer Manual, PowerDAQ PD2-MF(S), AO and DIO PCI DAQ boards, Windows 9x/NT/2000, Linux, RTLinux, RTAI and QNX, March 2001 Edition. The PowerDAQ software provides a command "PdDIORead" to retrieve state of the inputs immediately (e.g., acquire information from one or more detectors). This particular command was used in this demonstration example. Another command "PdDIOWrite" allows for output to a port, for example, to control an emitter (e.g., a TTL controllable emitter). The UEI hardware and software also allows for digital input change-of-state interrupts, which may cause an exemplary device to commence one or more actions, sequences, etc., upon a change-of-state of a radiation path (e.g., interrupted or uninterrupted or some degree thereof). Thus, an exemplary method may include initiating an action and/or an analysis upon interruption of one or more emitter to detector paths.

With respect to sound generation and/or sound effects (e.g., adjustments to sound), MIDI commands were sent in response to various information acquired by the PDL-DIO-64ST card. In particular, the PdDIORead command provided information from the detectors at a sampling rate of about 33,000 Hz (for a single 16 bit port), which was then used in control logic (e.g., VB program, etc.) to select an appropriate MIDI message. The MIDI message (or messages) was then sent to a MIDI device, which was selected from available MIDI devices. In general, MIDI devices include software synthesized ("SW synth") and/or hardware synthesized ("HW synth") capabilities. Further, hardware synthesized sounds or effects typically operate more quickly and exhibit less latency than software synthesized sounds or effects. Both types of sound and effects processing were used based on selection and capabilities (e.g., whether a PCI-based sound card was installed or not).

With respect to the aforementioned sampling rate, trials were performed using various internal and external timers, counters, etc. For example, the commands QueryPerformancCounter, QueryPerformanceFrequency, and timeGetTime may be used in Visual Basic 6.0. A program was set to run 200,000 loops with various commands and logic. The timeGetTime and QueryPerformanceCounter and QueryPerformanceFrequency commands both registered a time of approximately 6 seconds for the 200,000 loops, which corresponds to about $3\times10^{-5}$ s per loop or over 500,000 bits per second (e.g., 16 bits read per loop). Two calls to QueryPerformanceCounter registered a time of about $2\times10^{-6}$s, which may be considered an overhead for such time or counter measurements. Higher rates may be achieved by using faster processor and/or buses. For example, the set-up for this demonstration example used a docking station with a PCI-PCI bridge, which may be expected to operate at a lesser transfer rate than a PCI slot of a motherboard. Further, as described, various circuits are commercially available that may be suitable for use in registering time differences and sound generation and/or sound effects. For example, the company ATMEL (San Jose, Calif.) markets various DREAM® ICs for sound synthesis and processing (e.g., SAM97XX sound processors). Various features of the ATMEL ATSAM9753 IC ("Integrated Digital Music Instrument" IC) are mentioned further below.

In one demonstration example, an arrangement included two fan-beam emitters (per description of FIG. 32) and four detectors (per description of FIGS. 30A, 30B, 31) mounted on a breadboard (various other demonstration examples used the aforementioned plastic ring). The emitters were supplied with about 5.6 VDC and the detectors were supplied with about 3.3 VDC. The emitters were capable of saturating the detectors, which produced an output voltage of about 2.18 VDC (high state for PDL-DIO-64ST card). Ambient radiation from two halogen lights positioned about 55 cm overhead of the detectors produced an output voltage of about 0.7 VDC (below guaranteed low state for PDL-DIO-64ST card). A true RMS multimeter displayed a value of about 1.6 VDC upon intermittent fast hand waving interruption of the radiation paths, which was sufficient to cause a switch from high to low state of the PDL-DIO-64ST card). A Mini MAGLITE® flashlight (Mag Instrument, Inc., Calif.) focused to a spot and directed to a detector window was able to saturate the detector from a distance of about 25 cm. A shade with an opening of about 0.25 $cm^2$ greatly reduced the angle-of-view of the detector and the angles from which the Mini MAGLITE® flashlight could saturate the detector. As already mentioned, filters and/or compensation techniques may be used if an issue with stray/ambient radiation arises. In some instances, intermittent stray radiation may be compensated to some extent by pulsing emitters and/or acquiring information from detectors intermittently.

A spacing of approximately 30 cm existed between the emitters and the detectors (e.g., x-axis). Perpendicular to this distance, a distance of about 2 cm separated the emitters (e.g., y-axis). A spacing height of about 1.8 mm existed between detector windows (e.g., z-axis) while a spacing of about 7 mm existed between detector windows (e.g., y-axis).

The emitters were switched on and off (supply power) to determine various values using the computer arrangement per FIG. 34. A VB program loop count of 0 (detectors low on same loop) was registered for an emitter positioned to direct radiation directly on two of the detectors positioned at the same height. A loop count of 0 (detectors at different levels low on same loop) was also registered for an emitter positioned to direct radiation on two detectors at one level and an emitter positioned to direct radiation on two detectors at another level with a level spacing of approximately 1.8 mm. Again, each loop occurred in about $3\times10^{-5}$ s; thus, if an object interrupted a detector at the first level and then a detector at the second level with a loop count of 1, then the object may have a speed of approximately 60 meters per second (e.g., ~(1.8 mm)/($3\times10^{-5}$s)). Again, as mentioned in the tip-speed study, an "accent stroke" is likely to have a tip speed of approximately 13 meters per second.

In another demonstration example, volume of a sound (e.g., selected from percussion sounds of MIDI channel 9) was related to a time difference between interruption of a first emitter-detector path positioned at first axial position and a second emitter-detector path positioned at a second axial position. An equation was used whereby sound volume increased as the time difference decreased. The volume values were adjusted accordingly from 7 bit values of 0 to 127 and the following code was implemented: midimsg=&H90+(86*&H100)+(volume*&H10000)+channel (e.g., 9); and midiOutShortMsg hmidi, midimsg. Other possible maps or equations based on a trigger may be used, for example, an article entitled "Tweaking for Touch" by Norm Weinberg presents velocity curves for the Alesis DM Pro electronics (DRUM! Vol. 12, Issue 7, pp. 100–105, November/December 2003). Examples for the Alesis DM Pro include a 7 bit trigger mapped to a 7 bit velocity using linear, exponential, S-curve, inverted plots (e.g., equations, maps, etc.).

In yet another demonstration example, using the aforementioned plastic ring, a MIDI message (e.g., midiOutShortMsg) was sent only when two detectors experienced a change in state from a high state (uninterrupted) to a low state (interrupted) (e.g., using Boolean logic). The particular MIDI message caused the Audigy 2 ZS Platinum Pro card to produce a percussion sound. In another demonstration example, the two detectors were arranged with two fan-beam emitters positioned at different axial positions so that a time difference could also be determined and related to any of a variety of commands (e.g., volume, pitch bend, etc.). While these demonstration examples used MIDI commands, other manners of sound generation and/or sound effects may be used. Also, as already mentioned, information obtained from an exemplary device may optionally be used to control another sound unit (e.g., an electronic drum controller, etc.).

Figure 30A:
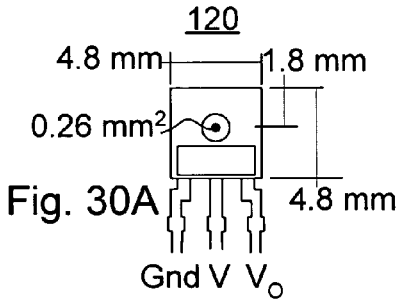
FIGS. 30A–30B are diagrams of an exemplary component used in various demonstrations.
Figure 30B:
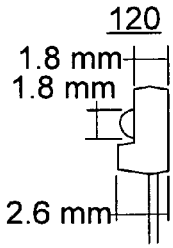

In another demonstration example, an emitter with optics to produce a fan-beam with a 90° fan angle (e.g., $\Delta\Theta_E$) per FIG. 32 exhibited an ability to saturate a detector per FIGS. 30A, 30B, 31 (supplied with about 3.3 VDC) over about 85° wherein the detector was positioned along an arc. The intensity decreased fairly rapidly at the edges of the fan-beam. Adjustments to detector front surface angle, supply voltage, etc., may act to increase an effective angle of an emitter.

In yet another demonstration example, an emitter was assembled with 90° fan-beam optics per FIG. 32 and a 90° prism. The exemplary assembly was constructed in part from black DELRIN® resin (DuPont, Delaware), a ring of such a resin may serve to house and/or as a support for various components and may be mountable to a drum. The prism included a mirrored surface and ABC dimensions of approximately 1.27 cm (Melles Griot, Rochester, N.Y.). As the distance between the emitter and the prism increased, the crosswise dimension of the beam impinging on the mirrored prism surface increased. In general, reflected beam intensity appeared to diminish as the crosswise beam dimension became larger than the 1.27 cm width of the prism. Further, this particular exemplary assembly may refer to FIG. 1C wherein the focus corresponds to the emitter and the $E_{Line}$ to the reflective surface of the prism, which may serve to define an emitter/detector path or ray. In general, positioning a fan-beam emitter at a distance from a circumference of a circle acts to increase the arc angle covered by the fan-beam along the circumference and increase the $E_{Line}$, $E_{Arc}$, etc., at the circumference of the circle. Accordingly, an exemplary arrangement includes mounting one or more emitters at a distance from a circumference to thereby increase the illuminated arc angle along the circumference wherein the circumference optionally corresponds substantially to a circle. Such an arrangement may rely on prisms, mirrors, elbows and/or other components. Such an arrangement may include mounting the one or more emitters substantially perpendicular to a plane defined by a circumference.

Figure 35:
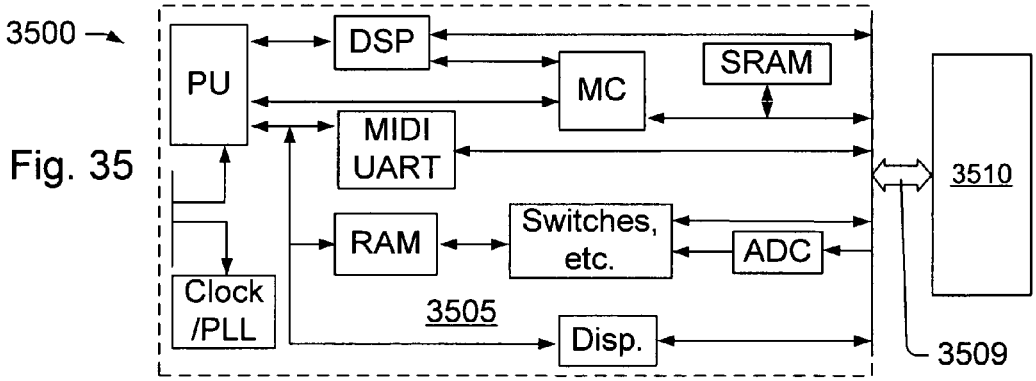
FIG. 35 is a block diagram of an exemplary arrangement that includes an IC.

FIG. 35 shows an exemplary arrangement 3500 that includes an IC 3505 such as, but not limited to, the aforementioned ATMEL ATSAM9753 IC, and an exemplary device 3510 that includes one or more emitters and one or more detectors. An information, and optionally power, bus 3509 connects the IC 3505 to the exemplary device 3510. The exemplary device 3510 optionally includes one or more circuits to facilitate operation of the exemplary arrangement 3500. For example, the exemplary device 3510 may include one or more multiplexers that operate in conjunction with a plurality of detectors, one or more signal conditioning circuits, and/or one or more control circuits for controlling the exemplary device 3510 based on information received from the IC 3505. Such an exemplary arrangement optionally implements various exemplary methods described herein and/or other methods (e.g., optionally selected from features of the ATMEL DREAM® ICs). Other circuitry such as that associated with the ATMEL ATSAM9753PIA-DK development kit and evaluation board based on the ATSAM9753 Integrated Digital Music Instrument is optionally included in such an exemplary arrangement.

The ATMEL ATSAM9753 IC includes a keyboard velocity scanner, a switch scanner (e.g., up to 176 switches), a LED display controller, a slider scanner (e.g., built-in ADC), a LCD display (e.g., 8-bit interface), 45 MHz, 16-bit microcontroller, interface capabilities for keyboard/switches through built-in shared memory, a 64-slot digital sound synthesizer/processor, and other features. Keyboard contact 1 and keyboard contact 2 features of the ATMEL ATSAM9753 IC act to hold a keyboard key-off or first contact status and to holds a keyboard key-on or second contact status. Such features may optionally operate in conjunction with information acquired from the exemplary device 3510.

Figure 36:
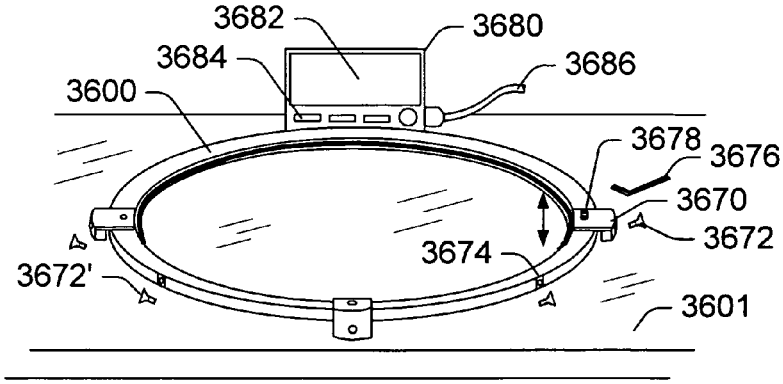
FIG. 36 is a diagram of an exemplary device and associated exemplary components.

FIG. 36 shows an exemplary device 3600 and various associated components. The device 3600 may include any of a variety of exemplary arrangements of one or more emitters and one or more detectors. A thick line on an inner circumference of the device 3600 approximates an area that may be associated with radiation of the one or more emitters and detectable by the one or more detectors. The thick line may represent a groove in the device 3600. The device 3600 rests on a surface 3601. A lower surface of the device 3600 may contact the surface 3601 and/or one or more mounts 3670 may contact the surface 3601 and optionally allow for adjusting the position of the device 3600 with respect to the surface 3601. In one example, a hex wrench 3676 fits a hex headed rotatable shaft 3678 wherein rotation of the shaft 3678 causes the device 3600 to translate with respect to a base of the mount 3670 and hence alter the position of the device 3600 with respect to the surface 3601. The mount 3670 optionally allows for a gap between the device 3600 and a portion of the mount 3670 whereby a retainer of a drum (or other drum component) may be inserted at least partially in the gap. A screw 3672 may insert in an aperture of the portion of the mount 3670 to thereby allow for securing the device 3600 to the retainer. This exemplary mechanism may also allow for adjusting the device 3600 with respect to the retainer and/or the head of a drum (e.g., an acoustic drum, an electronic drum, etc.). A mount may cooperate with a shaft of a retainer of a drum and/or a fitting attached to such a shaft.

The exemplary device 3600 optionally includes an alternative or additional mount 3674. The mount 3674 may allow for securing the device 3600 to a retainer of a drum or other device. For example, if a retainer ring of a drum includes an aperture (or other shaped opening) in a substantially vertical wall, then a screw 3672' may be inserted in the aperture and received by the mount 3674. The mount 3674 may allow for translation and/or rotation of the device 3600 with respect to the retainer. An opening in a retainer may allow for translation and/or rotation of the device 3600 with respect to the retainer. Such translation and/or rotation may allow for alignment of the device 3600 with respect to a surface. An exemplary device may optionally pressure fit and/or screw (e.g., threads, bayonet, etc.) mount to a retainer or other component of a drum.

In this example, the exemplary device 3600 has an associated exemplary control component 3680. The control component 3680 includes a display 3682, various buttons and/or knobs 3684, and a cable 3686. The control component 3680 may include a circuit that includes various features of the aforementioned ATMEL integrated digital musical instrument IC and/or other features. In this example, the control component 3680 powers the device 3600 and processes information from the one or more detectors. The control component 3680 may also allow for pulsing of the one or more emitters (e.g., simultaneous, sequential, etc.). The control component 3680 may output a MIDI signal, a line level signal for sound, etc. The control component 3680 optionally communicates such information wirelessly and/or optionally operates via battery or other contained power source. The cable 3686 may provide power to the control component 3680 (e.g., consider the aforementioned IEEE 1394 standard, etc.).

The control component 3680 is optionally controlled via input from interrupting a radiation path of the device 3600 (e.g., change-of-state, etc.). In one example, the device 3600 is placed over a template such as a keyboard template that facilitates input. In this example, interruption of one or more paths may correspond to a letter, a number and/or a command. In another example, the display 3682 displays the position of an implement (e.g., a finger, a stick, a brush, etc.) as it interrupts one or more radiation paths of the device 3600. The displayed position may be with reference to one or more buttons displayed on the display 3682. During operation of the exemplary device 3600 as a musical instrument, an effects controller, etc., the display 3682 may display information. The control component 3680 optionally controls the number of active radiation paths.

The control component 3680 optionally includes removable memory (e.g., RAM, CD, mini-CD, etc.) that may be programmable, capable of storing sound information and/or sound commands, etc. The control component 3680 optionally interfaces with a computer for programming. In one example, the control component 3680 stores information input via interruption of one or more radiation paths and then allows for use of such information to reproduce sound (e.g., via MIDI messages, mp3, etc.). The MIDI specification is maintained by MIDI Manufacturers Association. Recent specifications include MIDI 1.0 v96.1; SP-MIDI; XMF v.1.01; GM-Lite; DLS; GM-2 v 1.1; and MIDI/IEEE-1394. Such specifications give a more complete listing of sounds, sound effects, files, etc., associated with the MIDI protocol. The exemplary control component 3680 optionally operates using one or more features associated with the MIDI protocol. In one example, the control component 3680 is adjustable, removable, etc. For example, the control component 3680 may adjust downward and/or be removable and connectable by a cable and/or a socket (e.g., optionally positionable by a player to a preferable location).

The control component 3680 may allow for selection of a variety of sounds and/or a variety of virtual control surfaces and/or volumes. Virtual control surfaces and/or volumes are typically defined by one or more radiation paths. The control component 3680 may control an electronic drum, for example, where the device 3600 is used in conjunction with a conventional electronic drum. The control component 3680 may be capable of receiving and/or transmitting information, for example, via a network. During a performance, such as a studio performance, the control component 3680 may receive timing and/or other information germane to the performance. The control component 3680 may display music notation, for example, a song, a percussion part of a song, etc.

The invention claimed is:

1. An apparatus comprising:

an emitter to emit radiation as a fan-beam substantially parallel to a head of a drum;

a substantially arcuate array of detectors positioned to detect radiation emitted by the emitter, each detector responsive to a decrease in radiation caused by an object interrupting a radiation path between the emitter and the detector; and an interface that allows for acquisition of information related to detected radiation.

2. The apparatus of claim 1 further comprising a mount for mounting the apparatus to the drum.

3. The apparatus of claim 1 further comprising a second emitter to emit radiation as a fan-beam substantially parallel to the head of the drum.

4. The apparatus of claim 1 wherein an uninterrupted radiation path causes a detector to produce a first voltage associated with a first state and wherein an interrupted radiation path causes the detector to produce a second voltage associated with a second state.

5. An apparatus comprising:

a first emitter to emit radiation from a first perspective substantially parallel to a head of a drum;

a second emitter to emit radiation from a second perspective substantially parallel to the head of the drum;

detectors to detect interruptions in the radiation from the first perspective as caused by an object; and detectors to detect interruptions in the radiation from the second perspective as caused by an object, wherein detected interruptions allow for determination of at least one member selected from a group consisting of sounds, sound effects and control actions.

6. The apparatus of claim 5 wherein the determination determines a parameter of a MIDI message.

7. The apparatus of claim 5 further comprising a mount for mounting the apparatus to the drum.

8. The apparatus of claim 5 wherein at least one detector can detect interruptions in the radiation from the first perspective and can detect interruptions in radiation from the second perspective.

9. The apparatus of claim 5 wherein the first emitter and the second emitter are pulsed emitters.

10. The apparatus of claim 9 wherein the first emitter and the second emitter are pulsed at different times.

11. The apparatus of claim 5 further comprising a control component that includes a microprocessor.

12. A method comprising:

emitting radiation from a first perspective substantially parallel to a head of a drum;

emitting radiation from a second perspective substantially parallel to the head of the drum;

acquiring information from a first arcuate array of detectors wherein the information indicates whether an object interrupted the radiation from the first perspective and acquiring information from a second arcuate array of detectors wherein the information indicates whether an object interrupted the radiation from the second perspective; and based at least in part on the information, determining at least one member selected from a group consisting of sounds, sound effects and control actions.

13. The method of claim 12 wherein the first arcuate array of detectors and the second arcuate array of detectors include one or more common detectors.

14. The method of claim 12 wherein the emitting radiation from a first perspective and the emitting radiation from a second perspective occur at different times.

15. The method of claim 12 wherein the acquiring information from the first arcuate array of detectors and the acquiring information from the second arcuate array of detectors occur at different times.

16. The method of claim 12 wherein the acquiring information acquires state information.

17. The method of claim 16 wherein the state information specifies an interrupted state and an uninterrupted state.

18. The method of claim 12 wherein the acquiring and the determining are at least partially embodied in a computer-readable medium operable in conjunction with a microprocessor.

19. The method of claim 12 wherein the determining includes determining a velocity of the object.

20. The method of claim 12 wherein the emitting radiation from a second perspective occurs in response to a change-of-state in information from the first arcuate array of detectors.

* * * * *